US008186081B2

(12) United States Patent
Wilson, III et al.

(10) Patent No.: US 8,186,081 B2
(45) Date of Patent: May 29, 2012

(54) TORSION CONTROL DEVICES AND RELATED ARTICLES OF FOOTWEAR

(75) Inventors: C. Griffin Wilson, III, Portland, OR (US); Gerd R. Manz, Oberreichenbach (DE); Mark A. Henderson, Portland, OR (US); Robert Leimer, Nuremberg (DE); Timothy K. Robinson, Nuremberg (DE); Franz G. Rott, Portland, OR (US); Darren M. Wood, Gresham, OR (US)

(73) Assignee: adidas International Marketing B.V., Amsterdam ZO (NL)

( * ) Notice: Subject to any disclaimer, the term of this patent is extended or adjusted under 35 U.S.C. 154(b) by 765 days.

(21) Appl. No.: 12/272,420

(22) Filed: Nov. 17, 2008

(65) Prior Publication Data

US 2010/0122472 A1 May 20, 2010

(51) Int. Cl.
*A43B 13/42* (2006.01)
*A43B 13/14* (2006.01)

(52) U.S. Cl. ..... 36/76 R; 36/144; 36/30 R; 36/107

(58) Field of Classification Search ..... 36/107, 36/144, 30 R, 102, 31, 108, 142, 143, 76 R
See application file for complete search history.

(56) References Cited

U.S. PATENT DOCUMENTS

| | | | | |
|---|---|---|---|---|
| 1,662,814 | A * | 3/1928 | Alfred | 36/157 |
| 2,897,611 | A | 8/1959 | Schaller | |
| 3,976,059 | A | 8/1976 | Lonardo | |
| 4,547,981 | A | 10/1985 | Thais et al. | |
| 4,608,970 | A | 9/1986 | Marck et al. | |
| 4,882,856 | A * | 11/1989 | Glancy | 36/43 |
| 4,922,631 | A * | 5/1990 | Anderie | 36/102 |
| 5,452,526 | A | 9/1995 | Collins | |
| 5,720,117 | A | 2/1998 | Toschi | |
| 6,269,554 | B1 * | 8/2001 | Silvestrini et al. | 36/144 |
| 6,477,791 | B2 * | 11/2002 | Luthi et al. | 36/31 |
| 6,708,426 | B2 * | 3/2004 | Erickson et al. | 36/127 |
| 6,715,218 | B2 | 4/2004 | Johnson | |
| 6,874,257 | B2 * | 4/2005 | Erickson et al. | 36/127 |
| 7,143,529 | B2 * | 12/2006 | Robinson et al. | 36/127 |
| 7,421,805 | B2 * | 9/2008 | Geer | 36/25 R |
| 2005/0246922 | A1 | 11/2005 | Gibert et al. | |
| 2006/0283046 | A1 * | 12/2006 | Mason | 36/28 |

* cited by examiner

*Primary Examiner* — Ted Kavanaugh
(74) *Attorney, Agent, or Firm* — Sterne, Kessler, Goldstein & Fox P.L.L.C.

(57) ABSTRACT

Torsion control devices for use in an article of footwear are disclosed. An article of footwear comprises: a sole having a forefoot portion and a rearfoot portion; and a torsion element disposed in the sole, wherein the torsion element allows the forefoot portion to rotate in a first direction relative to the rearfoot portion and restricts rotation of the forefoot portion relative to the rearfoot portion in a second direction.

33 Claims, 28 Drawing Sheets

TORSION CONTROL DEVICES AND RELATED ARTICLES OF FOOTWEAR

FIELD OF THE INVENTION

The present invention generally relates to torsion control devices and articles of footwear including torsion control devices.

BACKGROUND OF THE INVENTION

There are numerous muscles, bones, and joints that contribute to the torsional movement of the foot, and various athletic maneuvers can create forces acting upon the these muscles, bones, and joints. Depending on the activity, some resistance to these forces may be desirable to prevent injury while not sacrificing the necessary freedom of movement to adequately perform the activity. For example, in sports like tennis and basketball, in which a participant may a make sudden change of direction, the foot may be subjected to forces which promote torsional movements. It may be desirable to resist these movements in one direction to prevent injury while allowing a freedom of movement in the opposite direction to improve traction and push-off.

Support devices for use in athletic footwear are available in a variety of configurations. Many of these devices incorporate rigid members, elastic materials or straps that, while possibly providing some stability, are often cumbersome and uncomfortable to the wearer. In addition, these devices often provide the same level of resistance regardless of the direction of the force, and can lead to excessive stiffening of the midfoot area which can detract from the overall freedom of movement of the foot.

BRIEF SUMMARY OF THE INVENTION

Embodiments of the present invention relate to an article of footwear, comprising: a sole having a forefoot portion and a rearfoot portion; and a torsion element disposed in the sole, wherein the torsion element allows the forefoot portion to rotate in a first direction relative to the rearfoot portion and restricts the degree of rotation of the forefoot portion relative to the rearfoot portion in a second direction.

Embodiments of the present invention also relate to an article of footwear, comprising: a sole having a forefoot portion and a rearfoot portion; and a torsion element disposed in the sole, wherein the torsion element provides a greater level of resistance against rotation of the forefoot portion relative to the rearfoot portion in a first direction than in a second direction.

Embodiments of the present invention further relate to a torsion control device for use in an article of footwear having a sole with a forefoot portion and a rearfoot portion, the torsion control device comprising: a first member having a base, a shaft extending from the base, and a slot formed around the shaft; and a second member having a base, a bore for receiving the shaft of the first member formed in the base and an extension adapted to rotate in the slot, wherein the extension rotates in the slot when the forefoot portion is subjected to a rotational force relative to the rearfoot portion in a first direction and wherein the extension resists rotation in the slot when the forefoot portion is subjected to a rotational force relative to the rearfoot portion in a second direction.

Embodiments of the present invention further relate to an article of footwear, comprising: a sole having a forefoot portion and a rearfoot portion; and a torsion element disposed in the sole, wherein the torsion element provides a first level of resistance against rotation of the forefoot portion relative to the rearfoot portion through a first range of rotation in a first direction and a second level of resistance against rotation through a subsequent range of rotation in the first direction.

Embodiments of the present invention further relate to an article of footwear, comprising: a sole having a forefoot portion and a rearfoot portion; and a torsion element disposed in the sole for providing resistance against rotation of the forefoot portion relative to the rearfoot portion, wherein the resistance provided abruptly increases through a first range of rotation in a first direction and gradually increases through a second range of rotation in the first direction.

Further embodiments, features, and advantages of the present invention, as well as the structure and operation of the various embodiments of the present invention, are described in detail below with reference to the accompanying drawings.

BRIEF DESCRIPTION OF THE DRAWINGS/FIGURES

The accompanying drawings, which are incorporated herein and form a part of the specification, illustrate the present invention by way of example, and not by way of limitation, and, together with the description, further serve to explain the principles of the invention and to enable a person skilled in the pertinent art to make and use the invention.

FIG. 1*a* is an exemplary illustration of a forefoot eversion.

FIG. 1*b* is an exemplary illustration of a forefoot inversion.

Figure 5A:
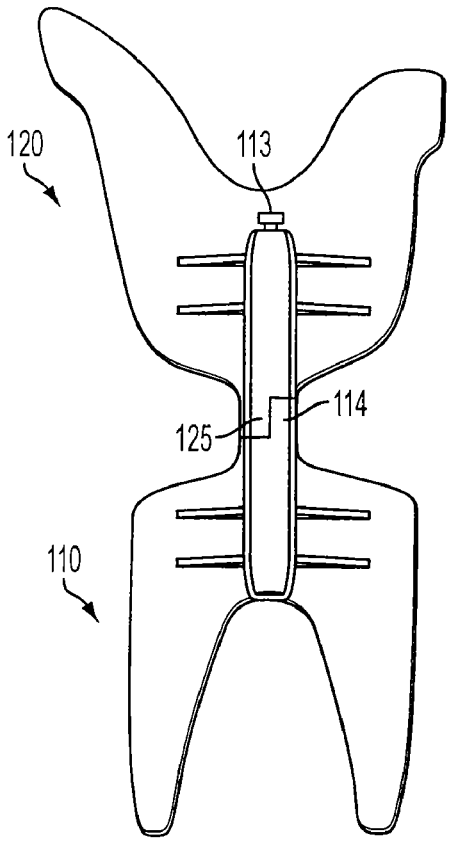

FIG. 5*a* is a bottom view of a torsion control element in a neutral position according to an embodiment of the present invention.

Figure 5B:
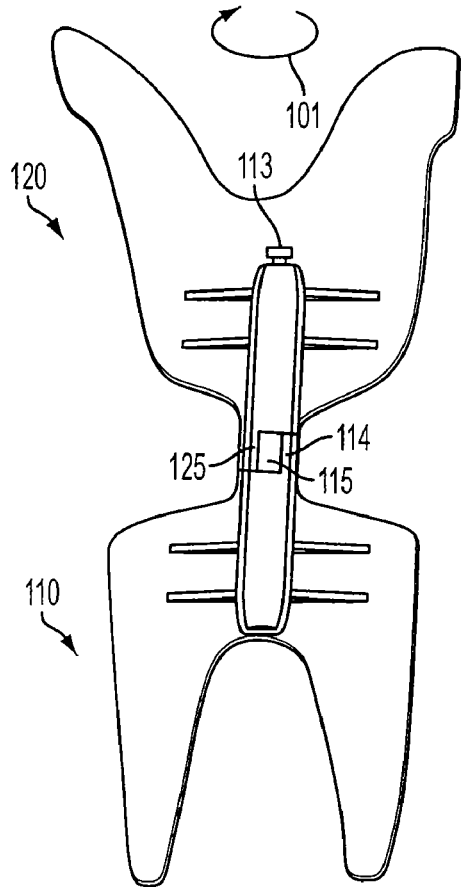

FIG. 5*b* is a bottom view of a torsion control element in a rotated position according to an embodiment of the present invention.

Figure 6:
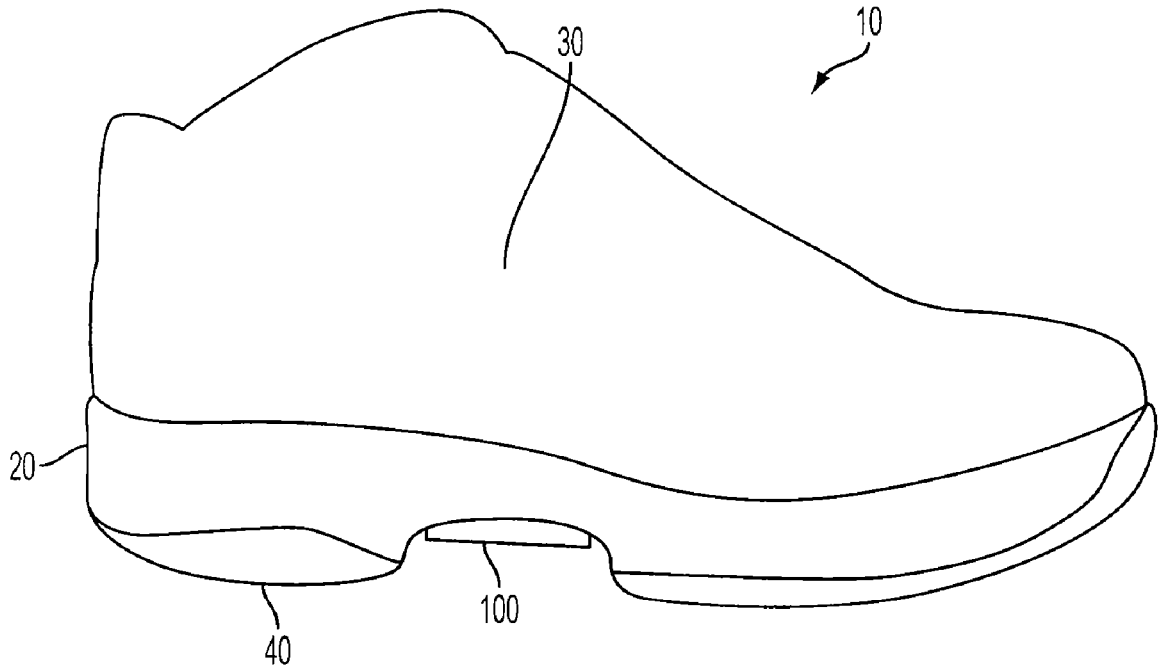

FIG. 6 is a side view of an article of footwear incorporating a torsion control element according to an embodiment of the present invention.

Figure 7:
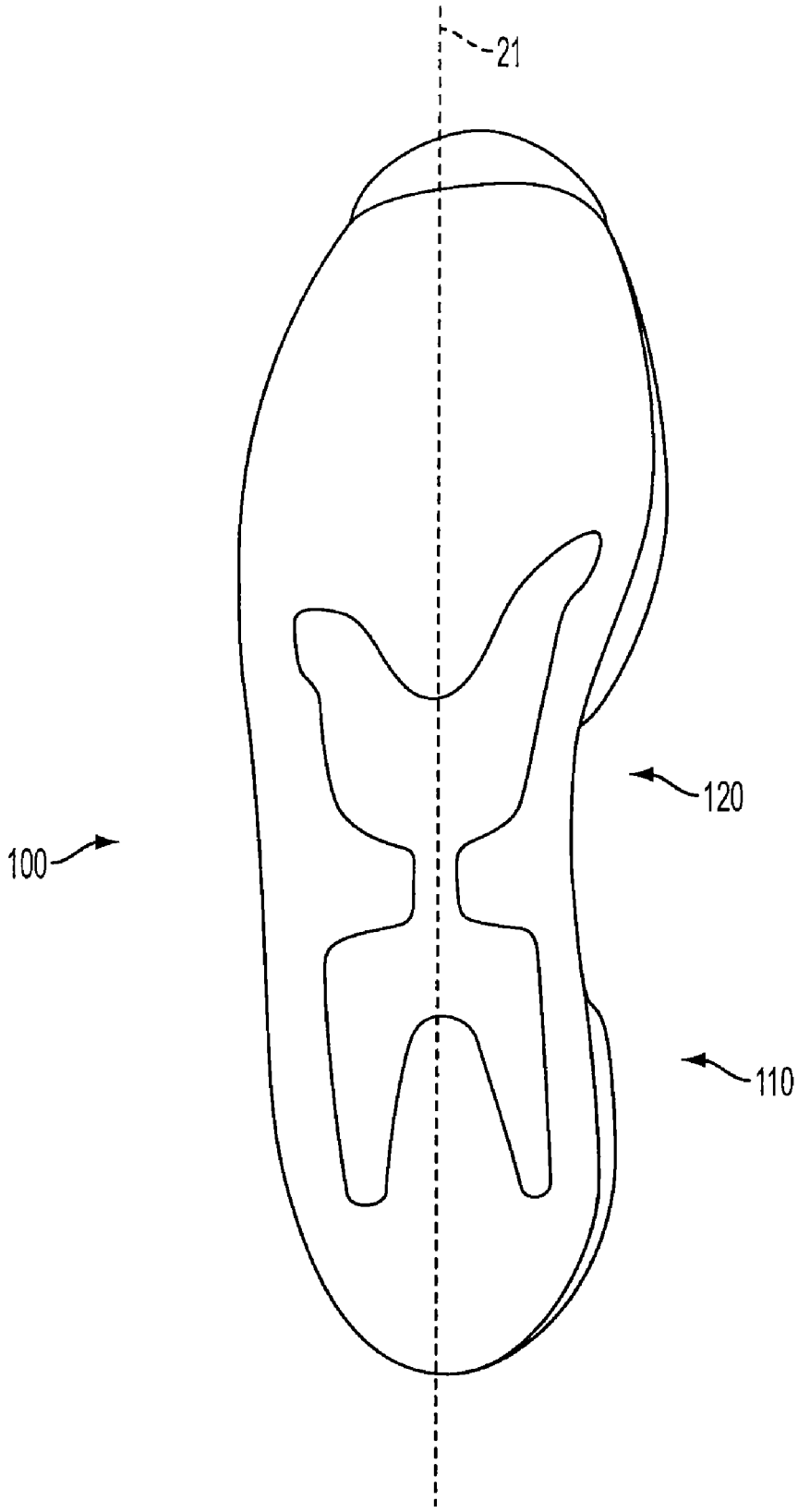

FIG. 7 is a cross-sectional top view of a torsion control element disposed in a sole according to an embodiment of the present invention.

Figure 8:
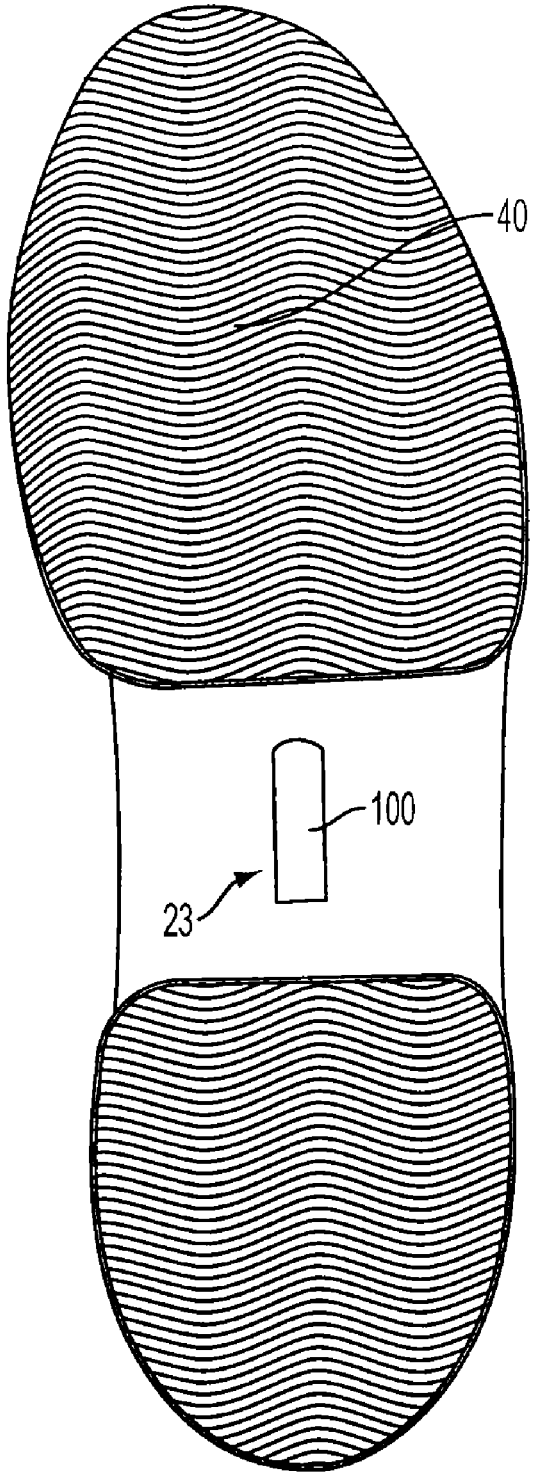

FIG. 8 is a bottom view of an article of footwear incorporating a torsion control element according to an embodiment of the present invention.

Figure 9:
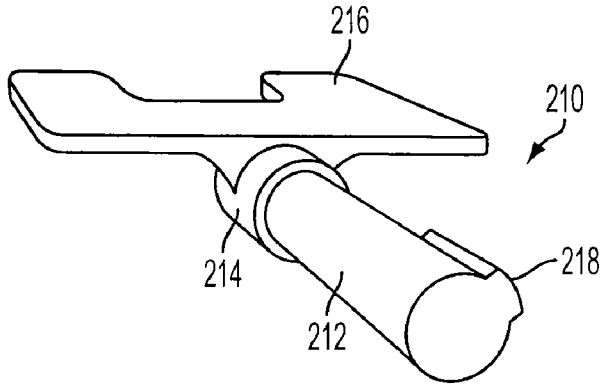

FIG. 9 is a perspective view of a first portion of a torsion control element according to an embodiment of the present invention.

Figure 10:
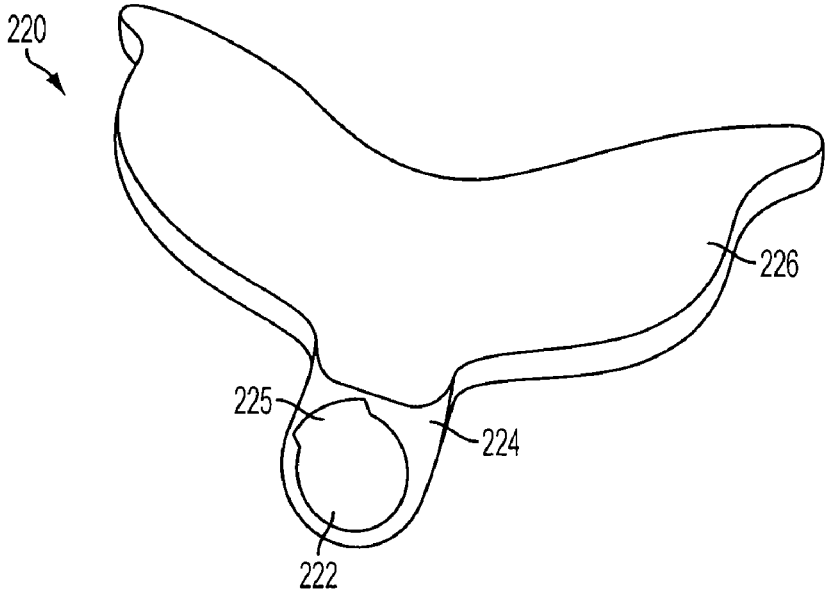

FIG. 10 is a perspective view of a second portion of a torsion control element according to an embodiment of the present invention.

Figure 11:
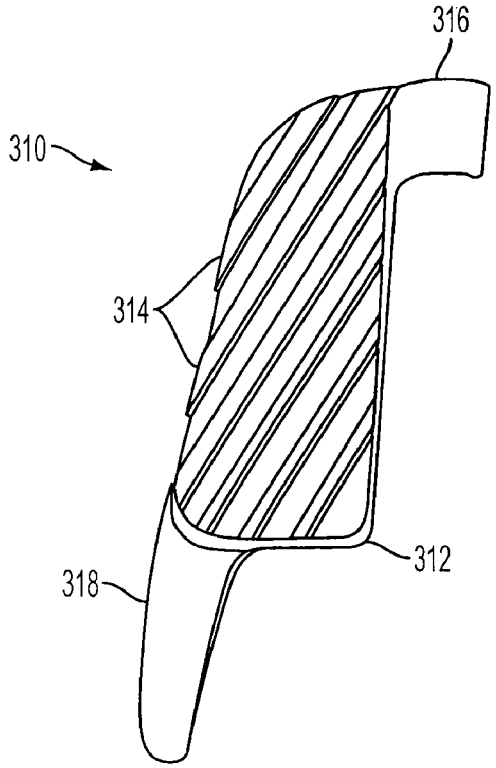

FIG. 11 is a bottom view of a first portion of a torsion control element according to an embodiment of the present invention.

Figure 12:
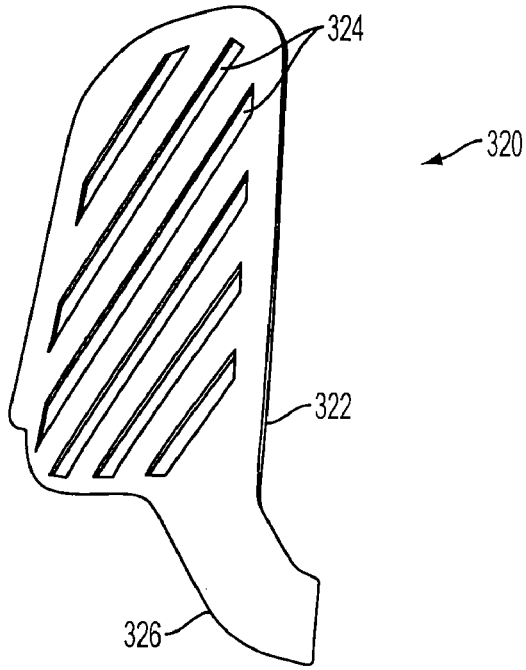
Figure 13:
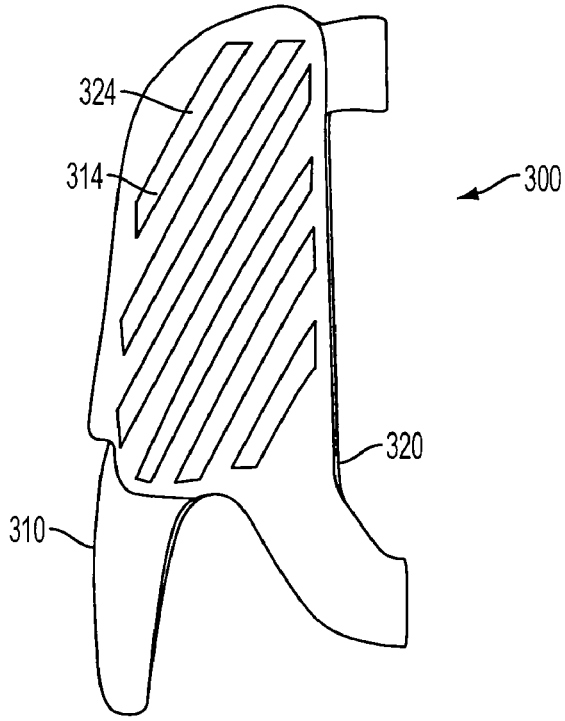

FIG. 12 is a bottom view of a second portion of a torsion control element according to an embodiment of the present invention FIG. 13 is a bottom view of the first portion shown in FIG. 11 operatively connected to the second portion shown in FIG. 12 according to an embodiment of the present invention.

Figure 14:
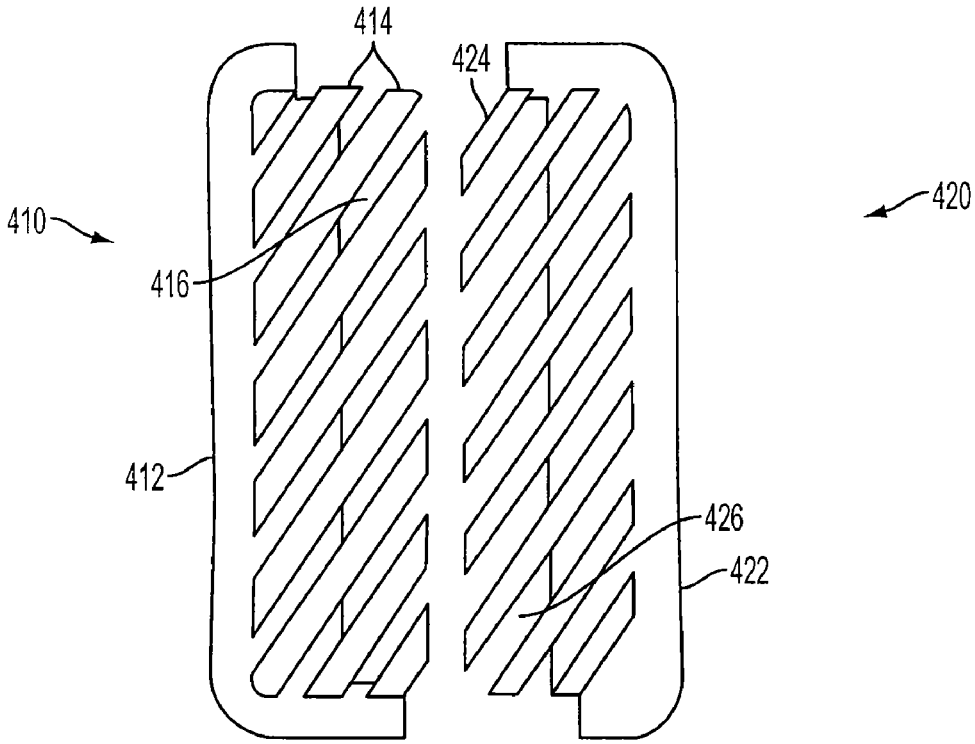

FIG. 14 is a bottom view of a first and second portion of a torsion control element according to an embodiment of the present invention.

Figure 15:
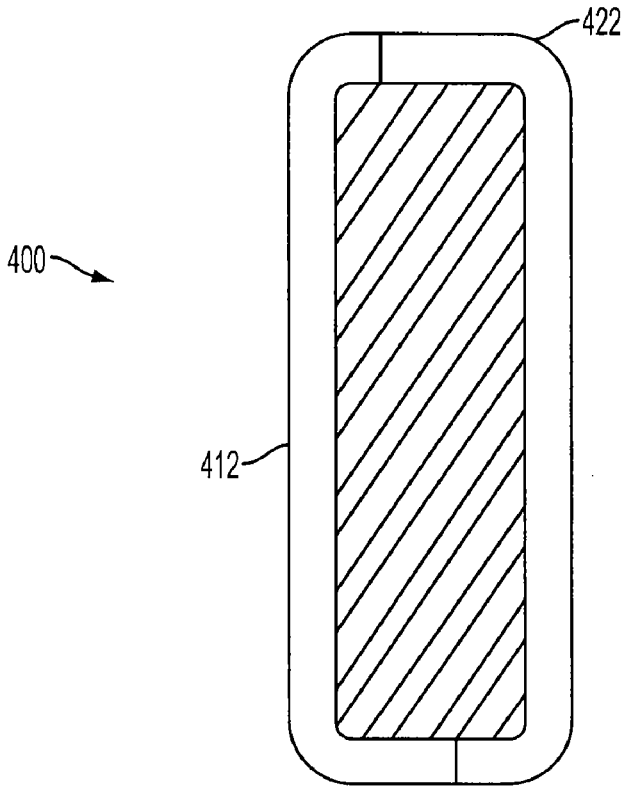

FIG. 15 is a bottom view of the first and second portions shown in FIG. 14 operatively connected according to an embodiment of the present invention.

Figure 16:
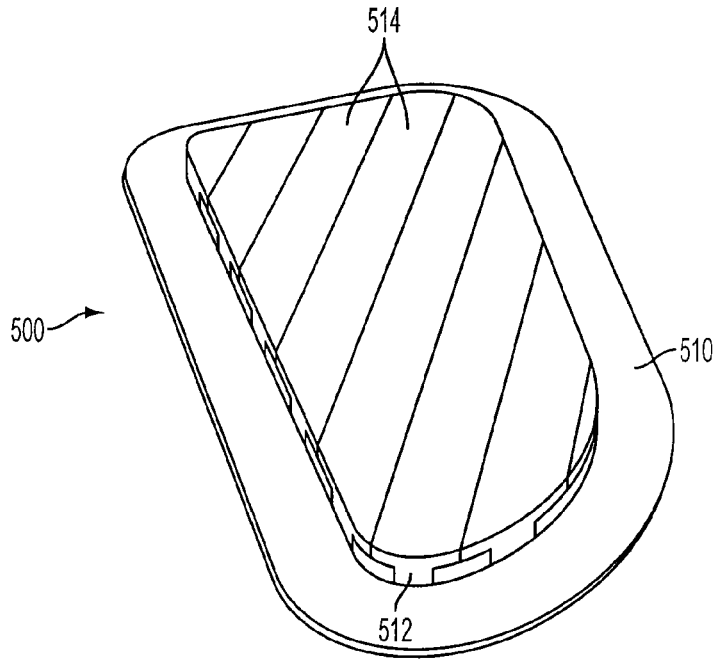

FIG. 16 is a perspective bottom view of a torsion control element according to an embodiment of the present invention.

Figure 17:
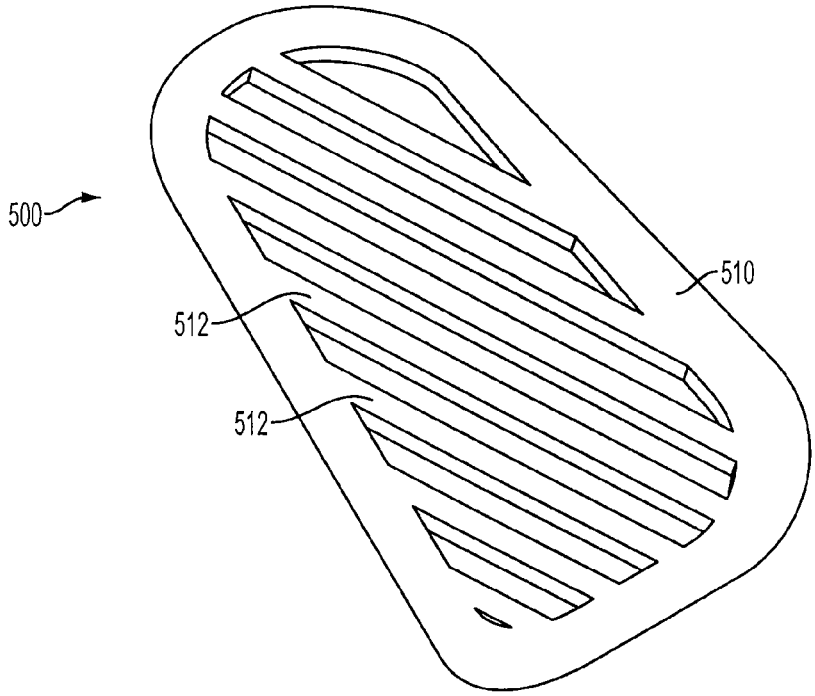

FIG. 17 is a top view of the torsion control element shown in FIG. 16.

Figure 18B:
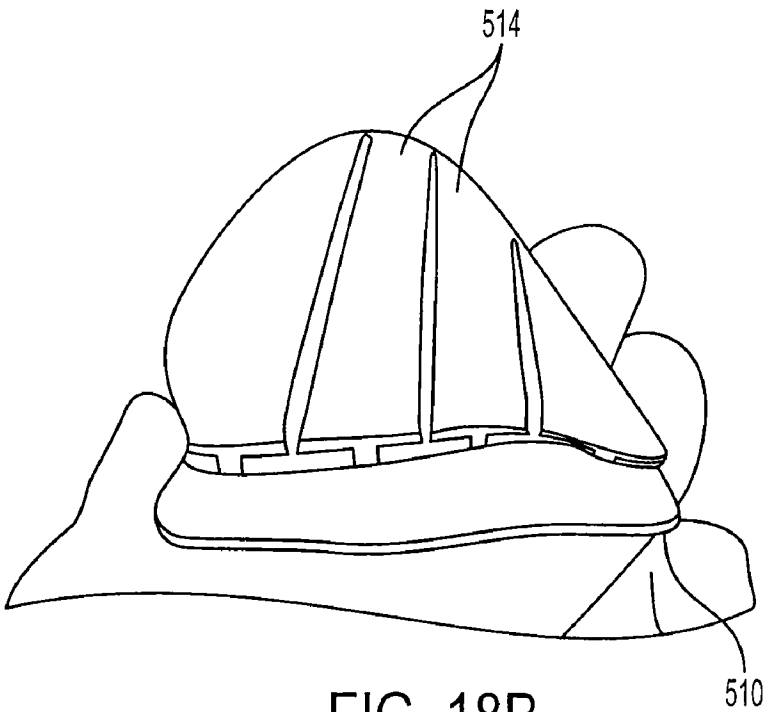
Figure 18A:
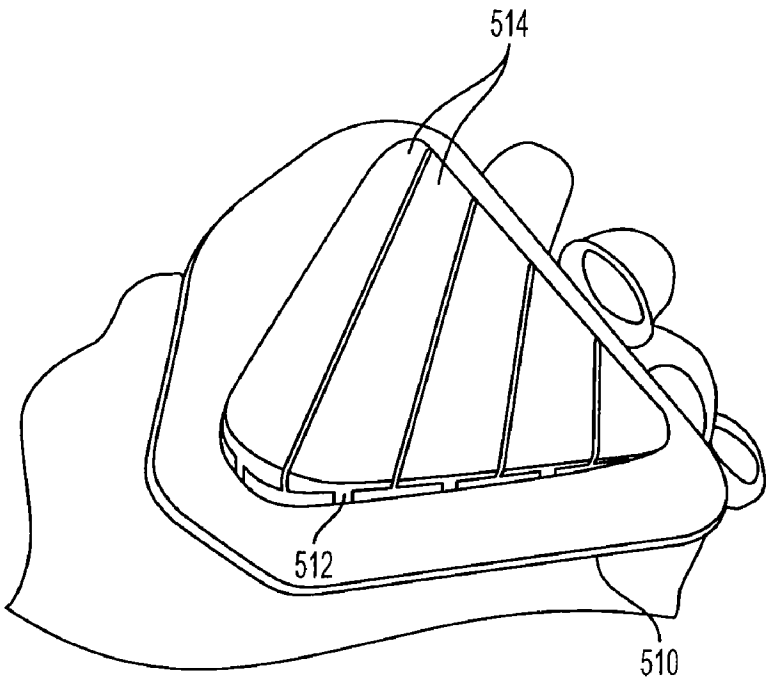

FIG. 18*a* is a perspective bottom view of the torsion control element of FIG. 16 in a neutral position according to an embodiment of the present invention.

FIG. 18*b* is a perspective bottom view of the torsion control element of FIG. 16 in a rotated position according to an embodiment of the present invention.

Figure 19:
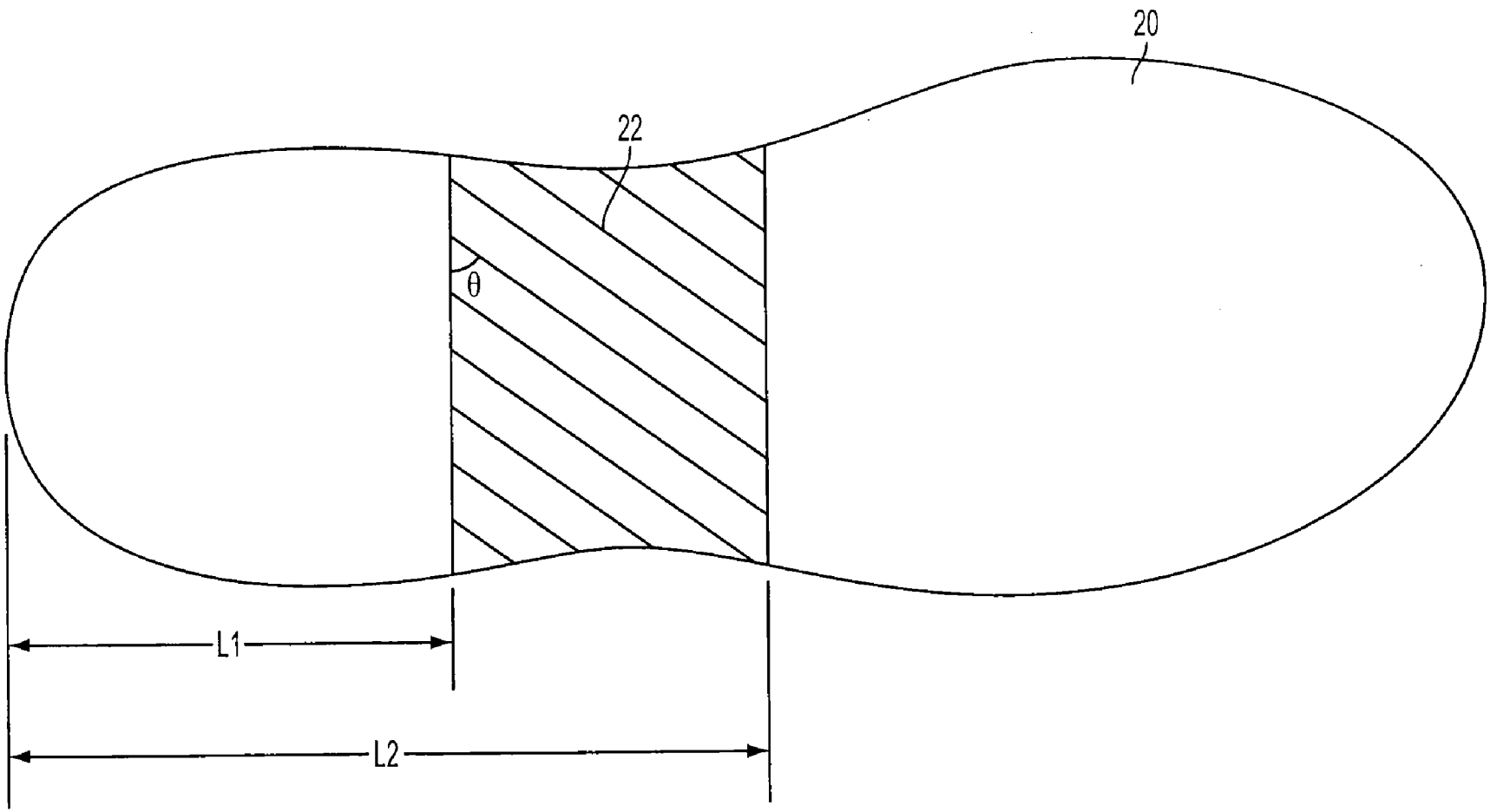

FIG. 19 is a perspective view of a shoe sole adapted as a torsion control element in a neutral position according to an embodiment of the present invention.

Figure 20:
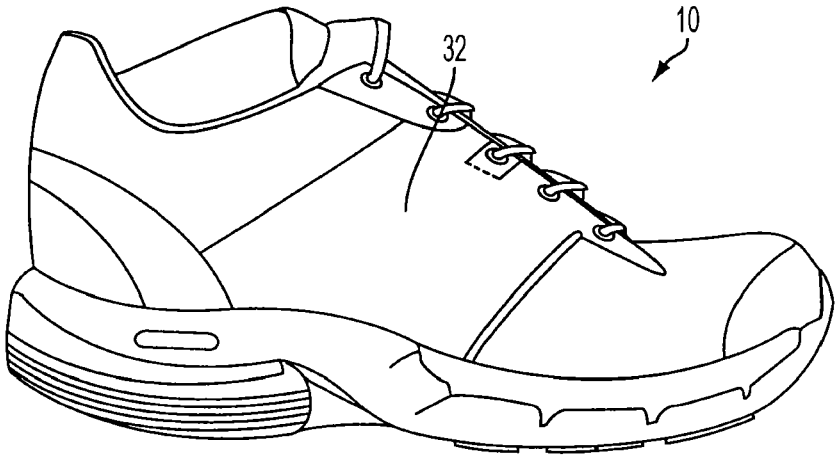

FIG. 20 is a shoe according to an embodiment of the present invention.

Figure 21:
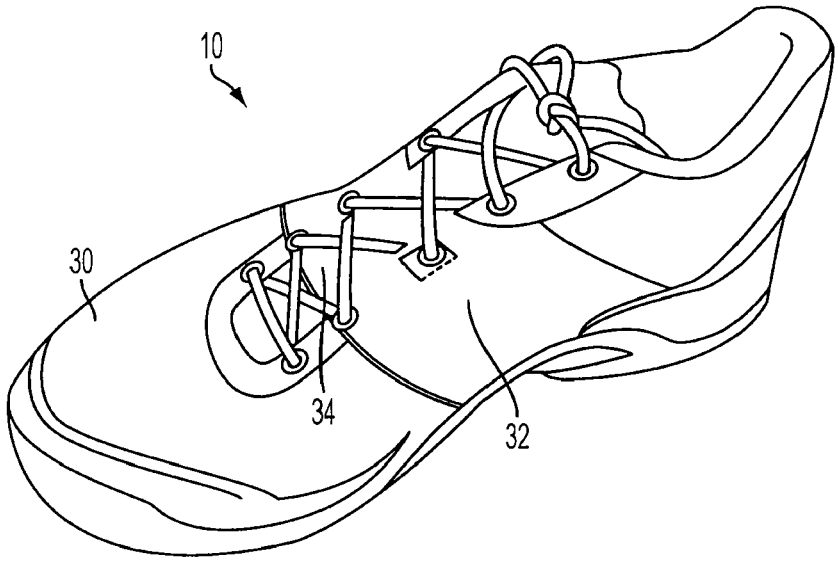

FIG. 21 is a shoe according to an alternative embodiment of the present invention.

Figure 22:
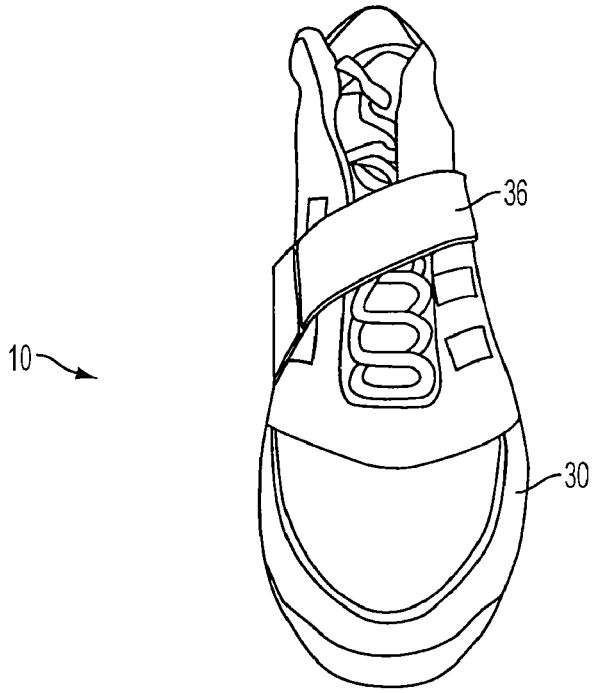

FIG. 22 is a shoe including a strap system according to an embodiment of the present invention.

Figure 23:
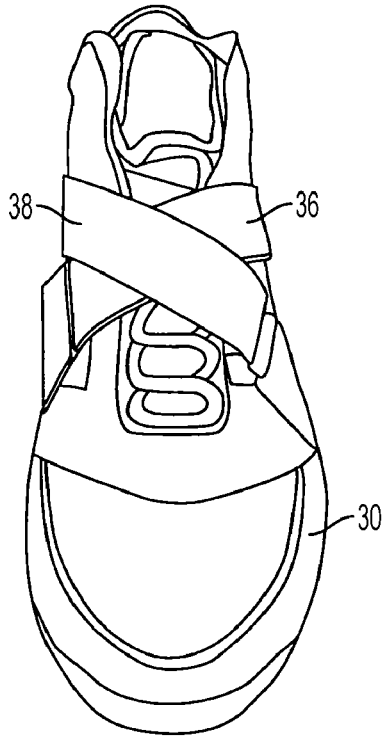

FIG. 23 is a shoe including an alternative strap system according to an embodiment of the present invention.

Figure 24:
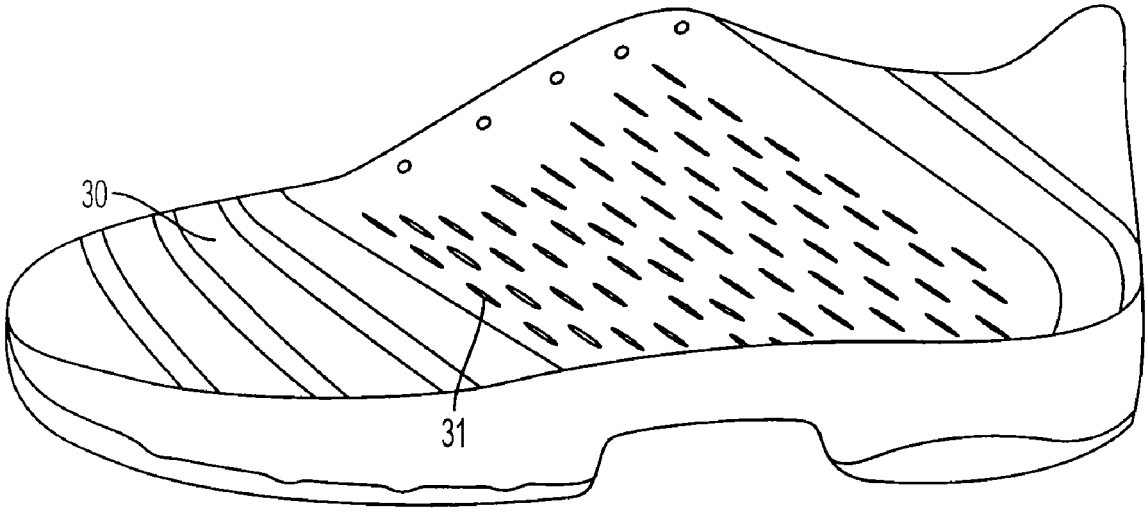

FIG. 24 is a shoe having flex lines according to an embodiment of the present invention.

Figure 25:
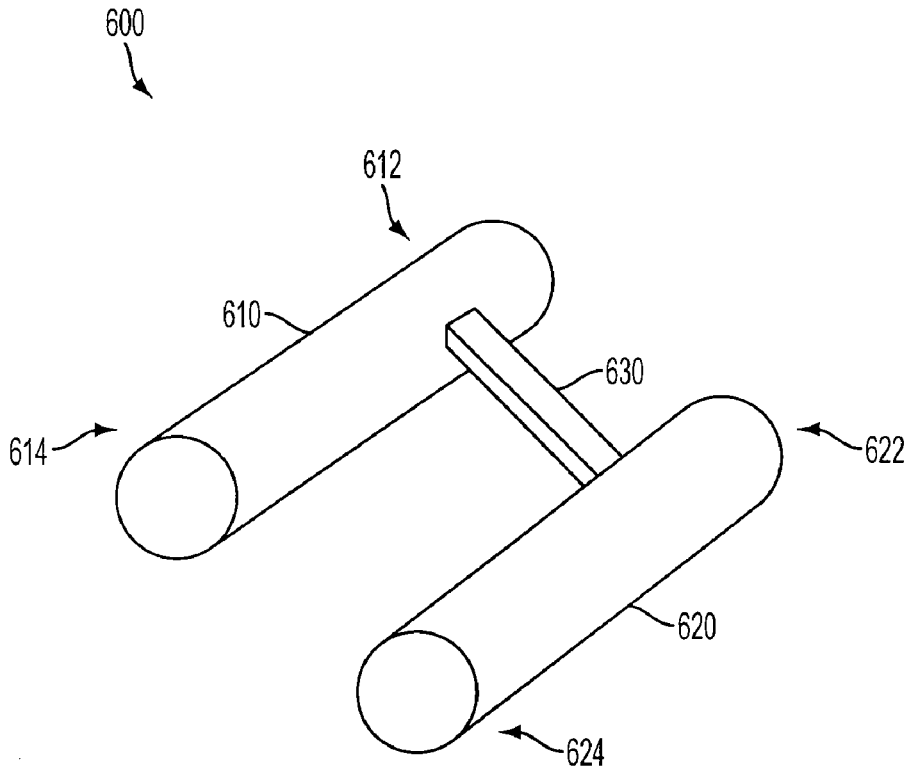

FIG. 25 is a perspective view of a torsion control element according to an embodiment of the present invention.

Figure 26:
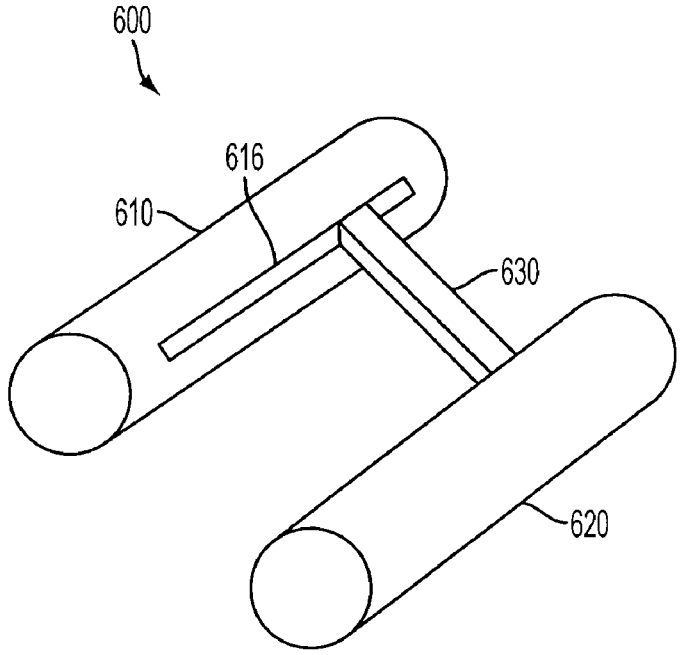

FIG. 26 is a perspective view of a torsion control element according to an embodiment of the present invention.

Figure 27:
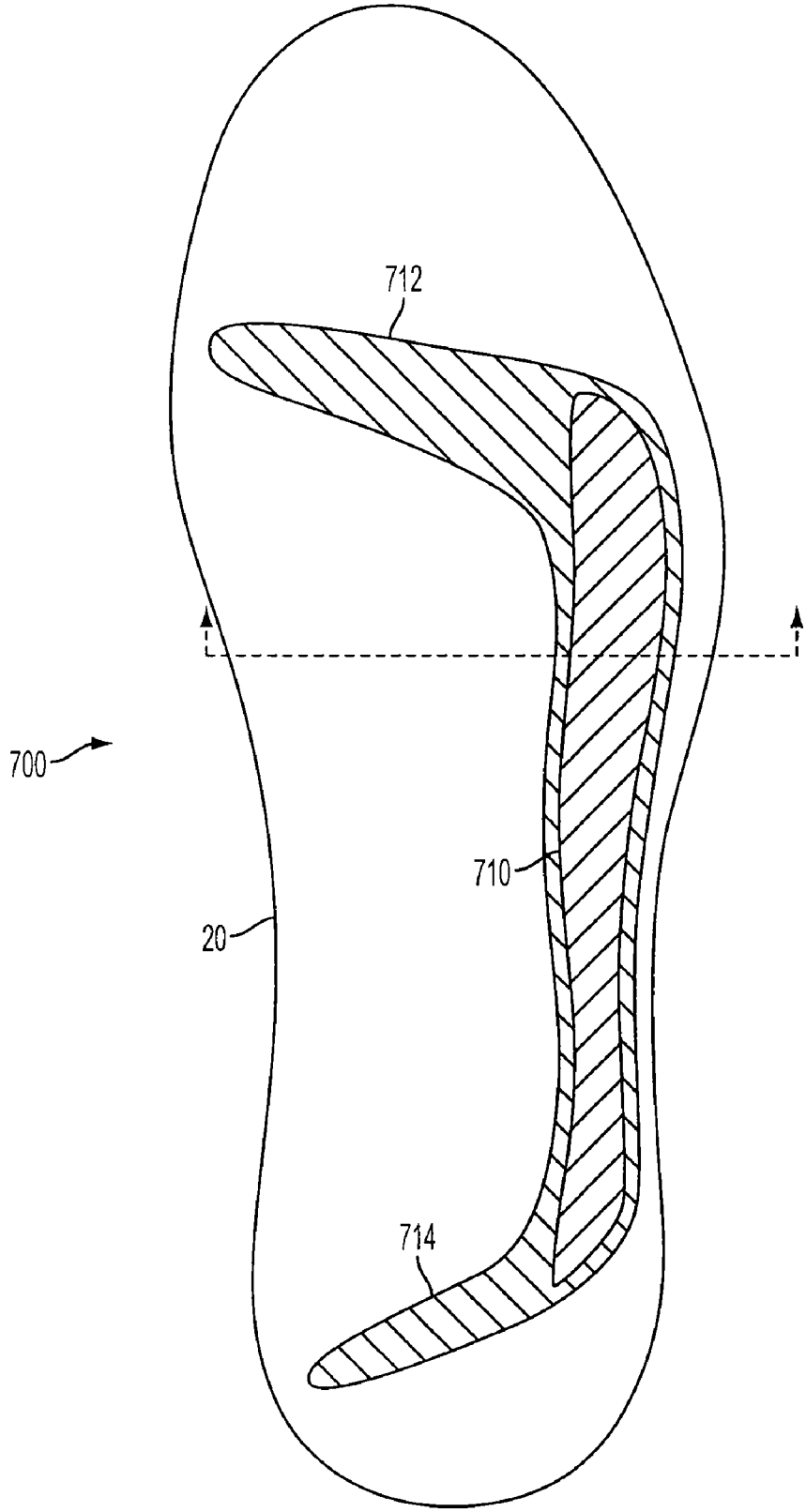

FIG. 27 is a top view of a torsion control element according to an embodiment of the present invention.

Figure 28:
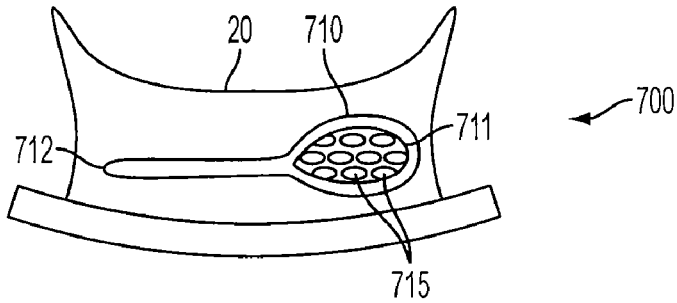

FIG. 28 is a cross-sectional view of the torsion control element shown in FIG. 27 according to an embodiment of the present invention.

Figure 29:
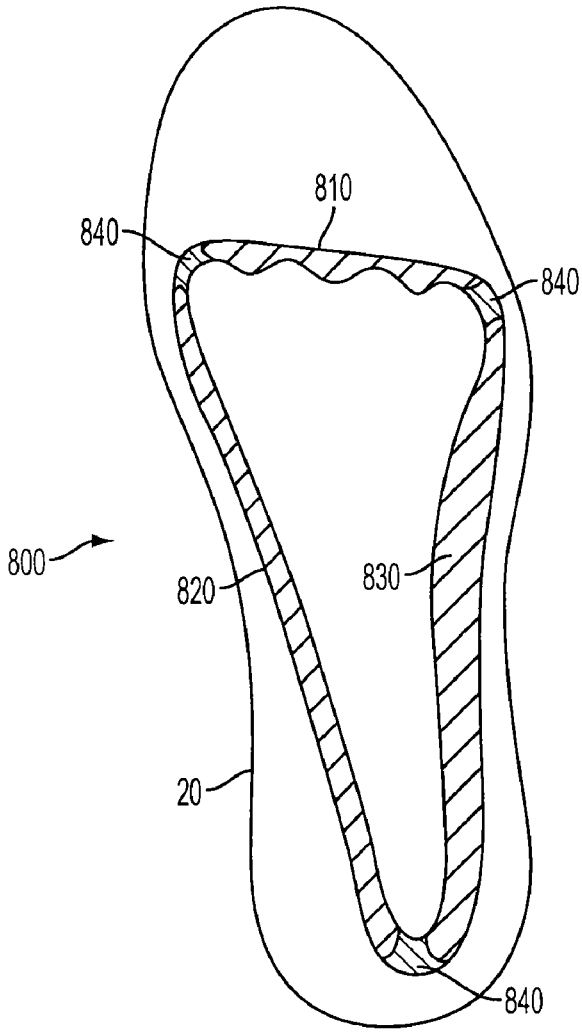

FIG. 29 is a top view of a torsion control element according to an embodiment of the present invention.

Figure 30:
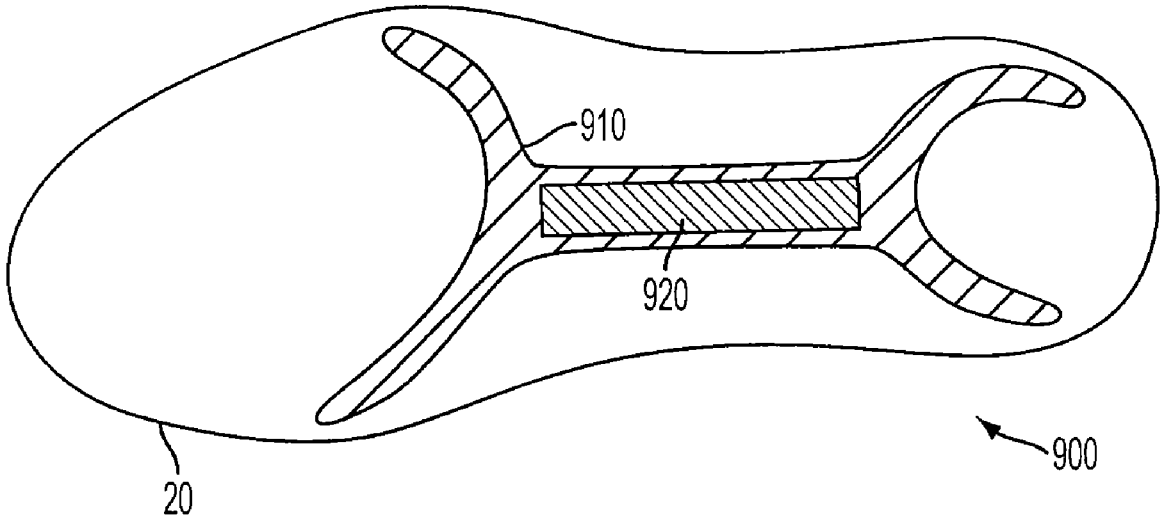

FIG. 30 is a top view of a torsion control element according to an embodiment of the present invention.

Figure 31:
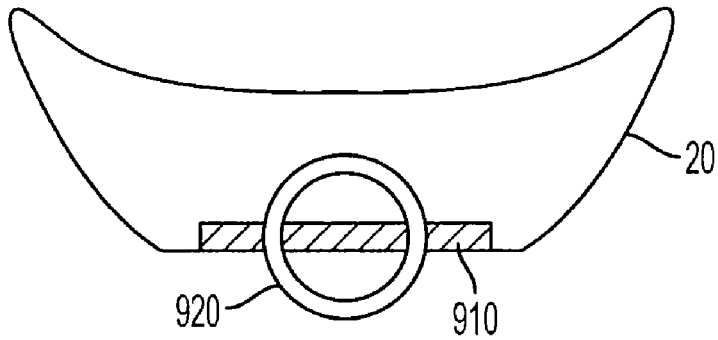

FIG. 31 is a cross-sectional view of the torsion control element shown in FIG. 30 according to an embodiment of the present invention.

Figure 32:
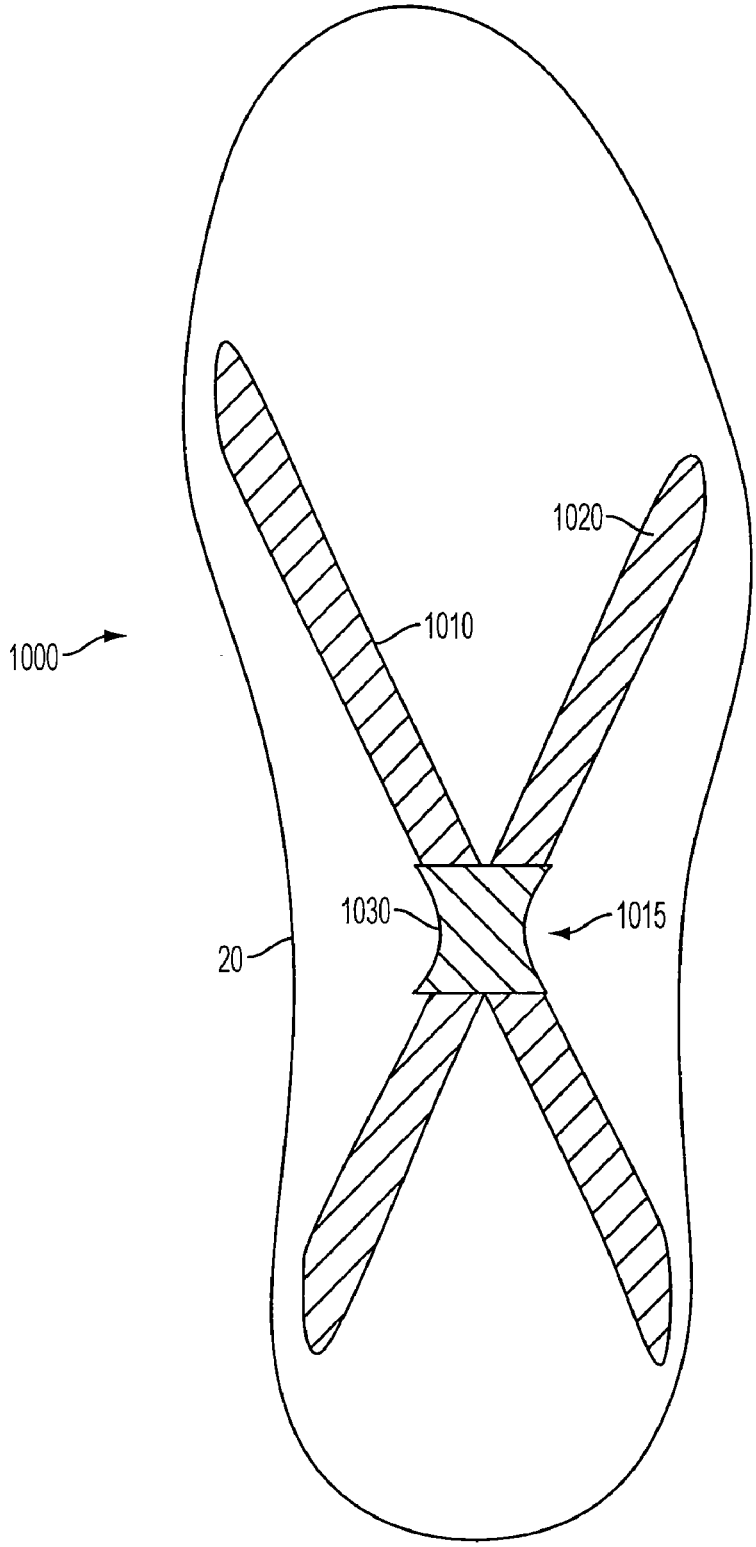

FIG. 32 is a top view of a torsion control element according to an embodiment of the present invention.

Figure 33:
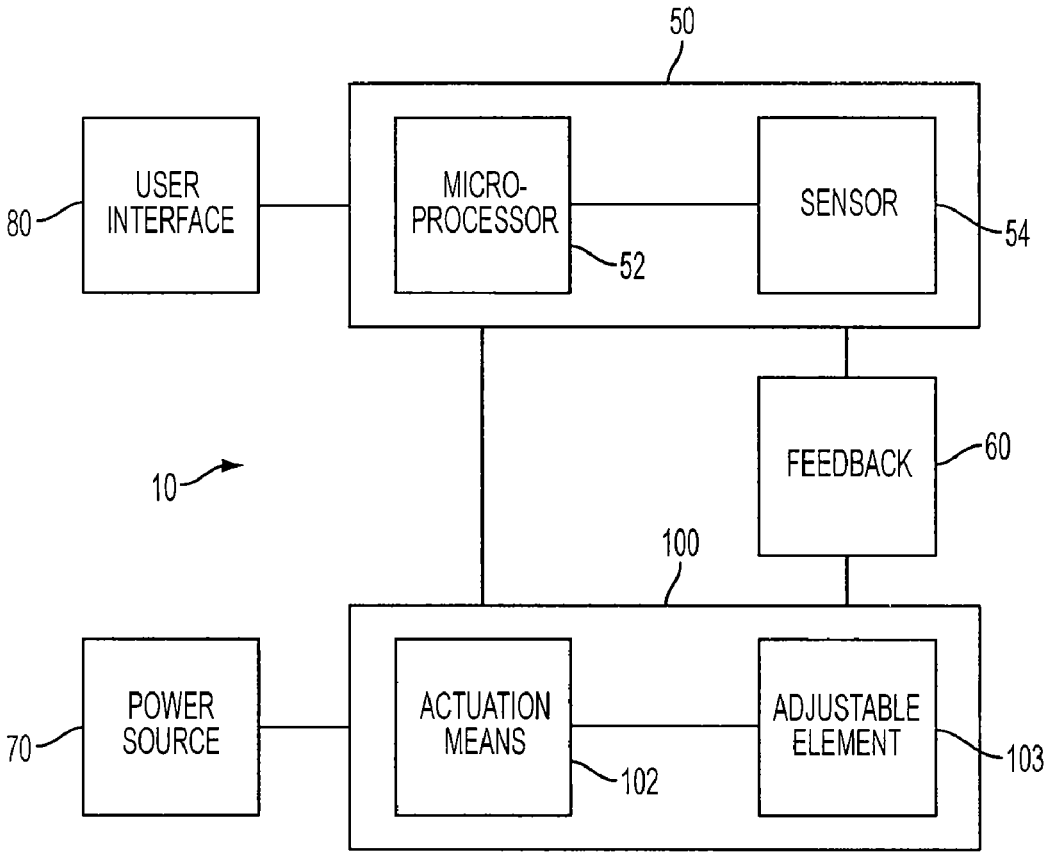

FIG. 33 is a block diagram of an intelligent shoe system according to an embodiment of the present invention.

Figure 34:
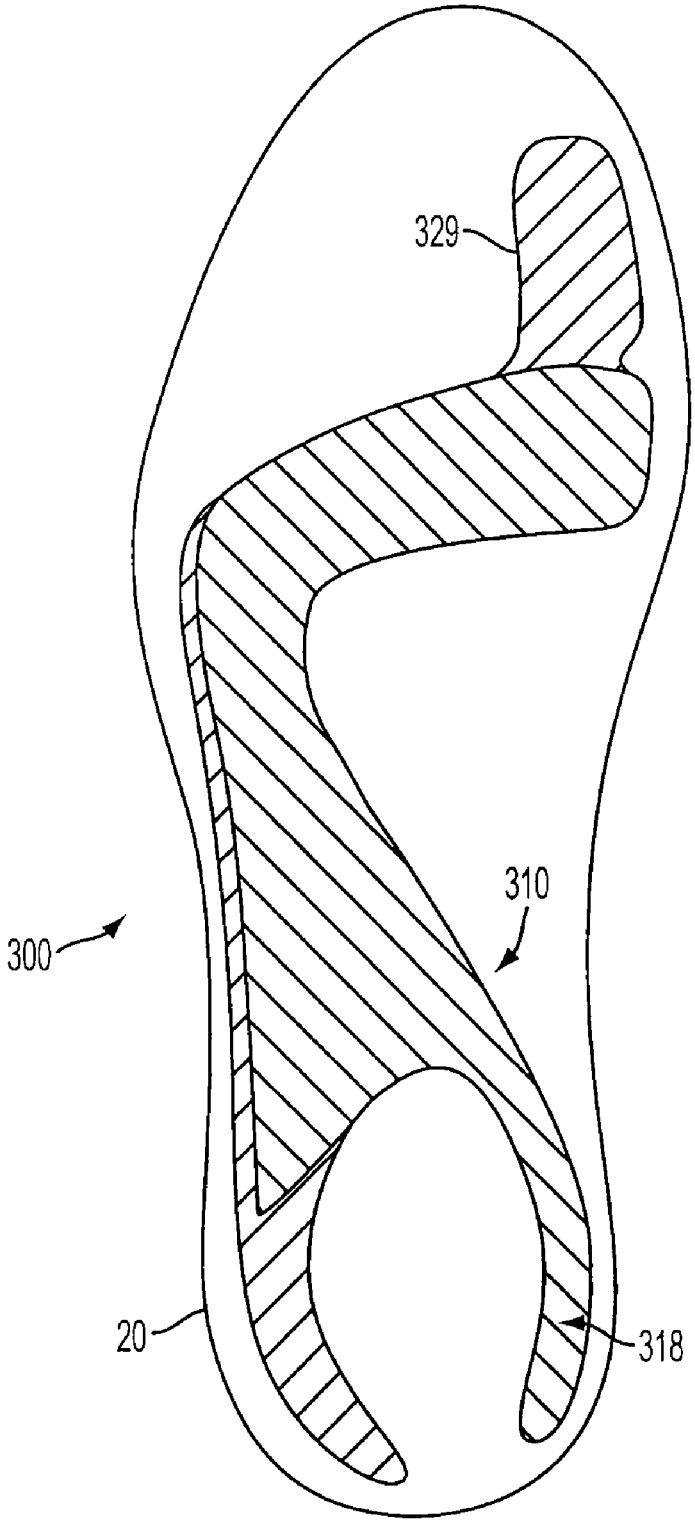

FIG. 34 is a top view of a torsion control element according to an embodiment of the present invention.

Figure 35:
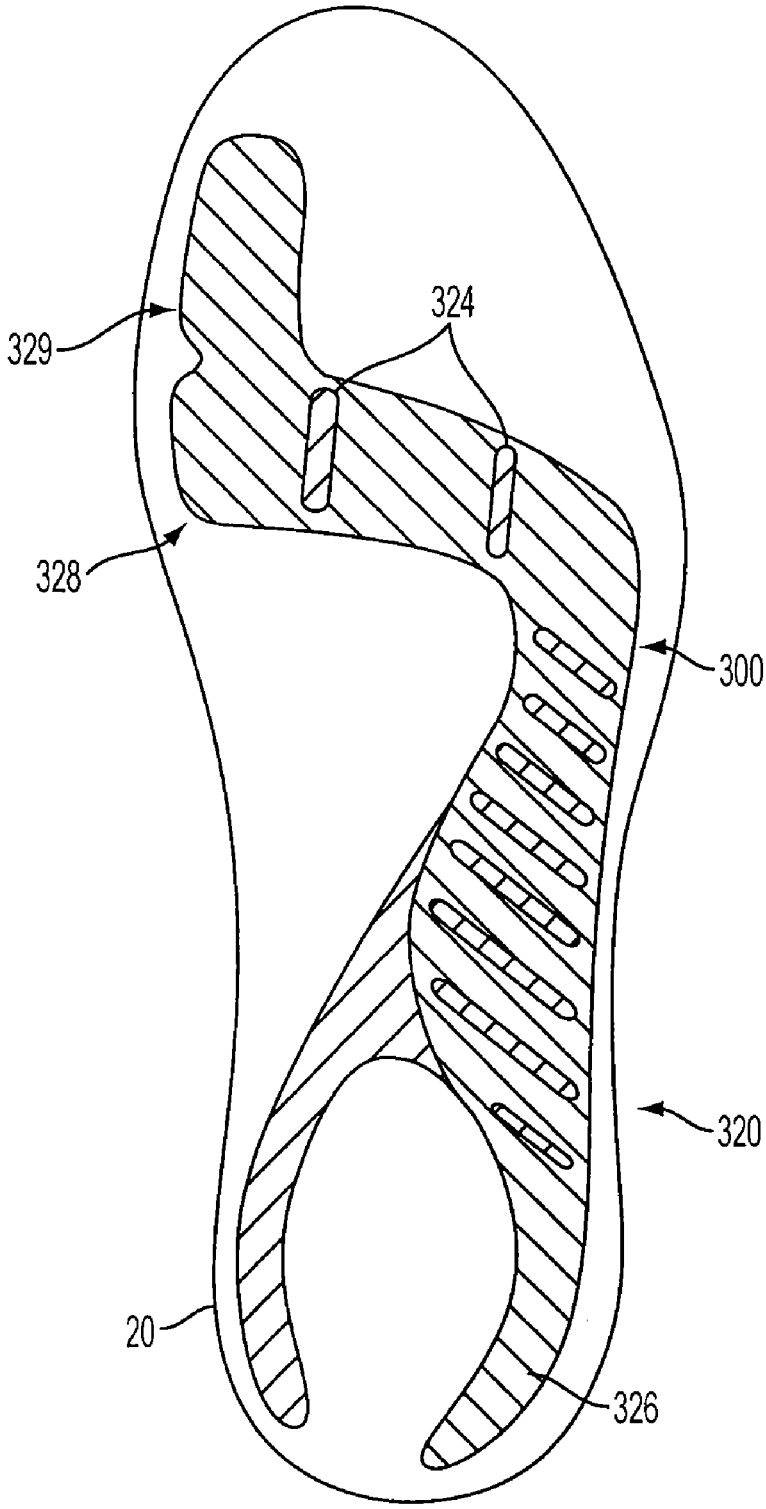

FIG. 35 is a bottom view of the torsion control element shown in FIG. 34 according to an embodiment of the present invention.

Figure 36:
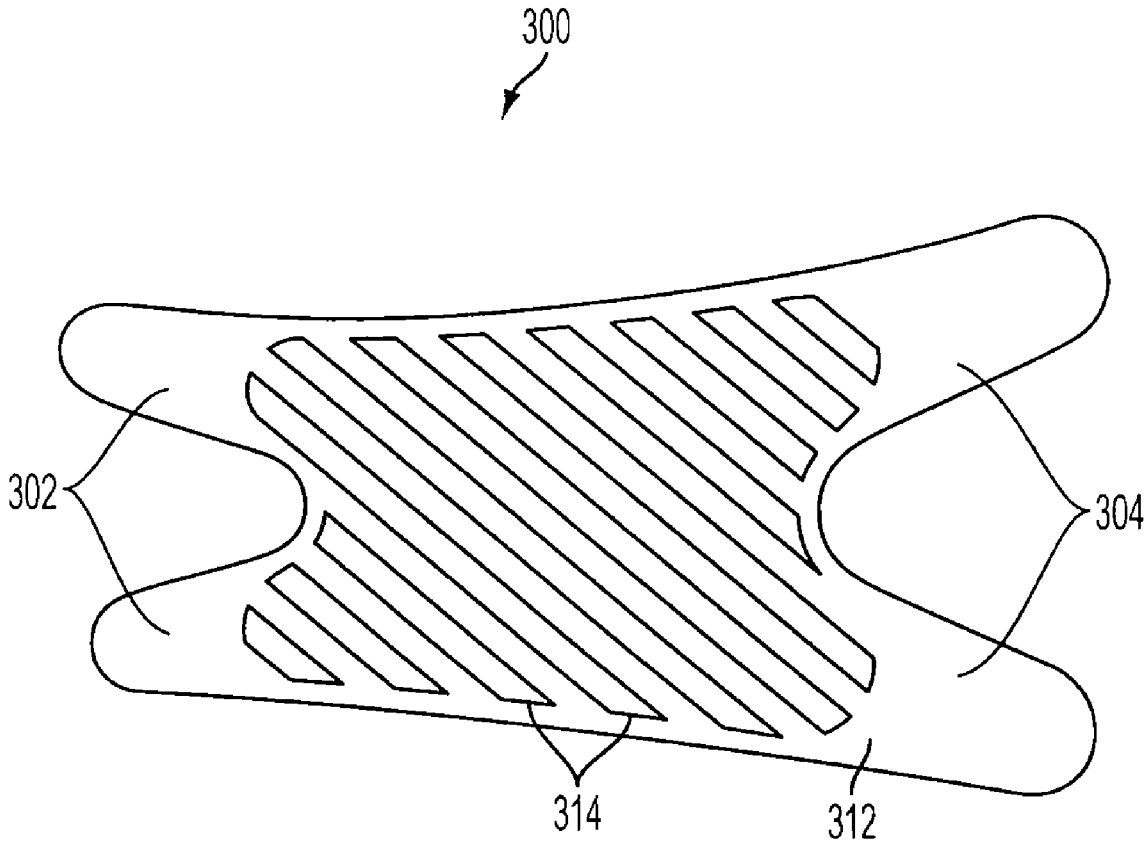

FIG. 36 is a bottom view of a torsion control element according to an embodiment of the present invention.

Figure 37A:
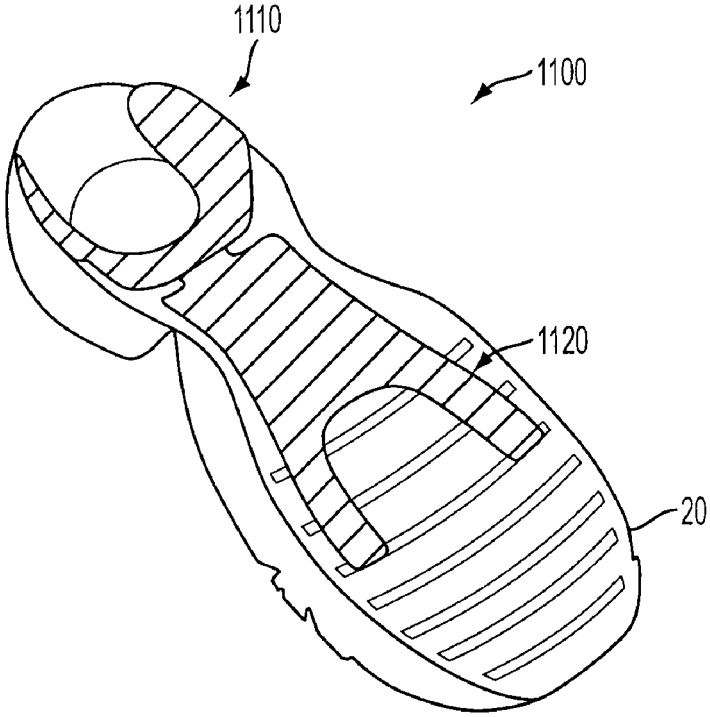

FIG. 37*a* is a perspective top view of a torsion element disposed in a sole of an article of footwear according to an embodiment of the present invention.

Figure 37B:
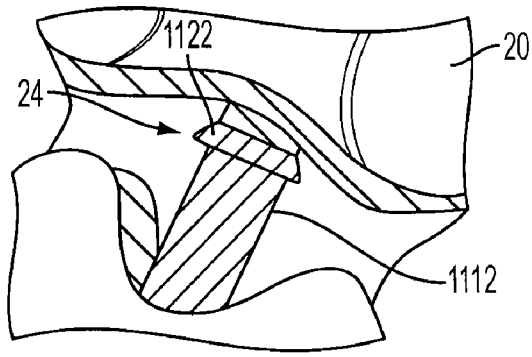

FIG. 37*b* is a close-up bottom view of a forefoot member-heel member connection of the torsion element shown in FIG. 37*a* according to an embodiment of the present invention.

Figure 38:
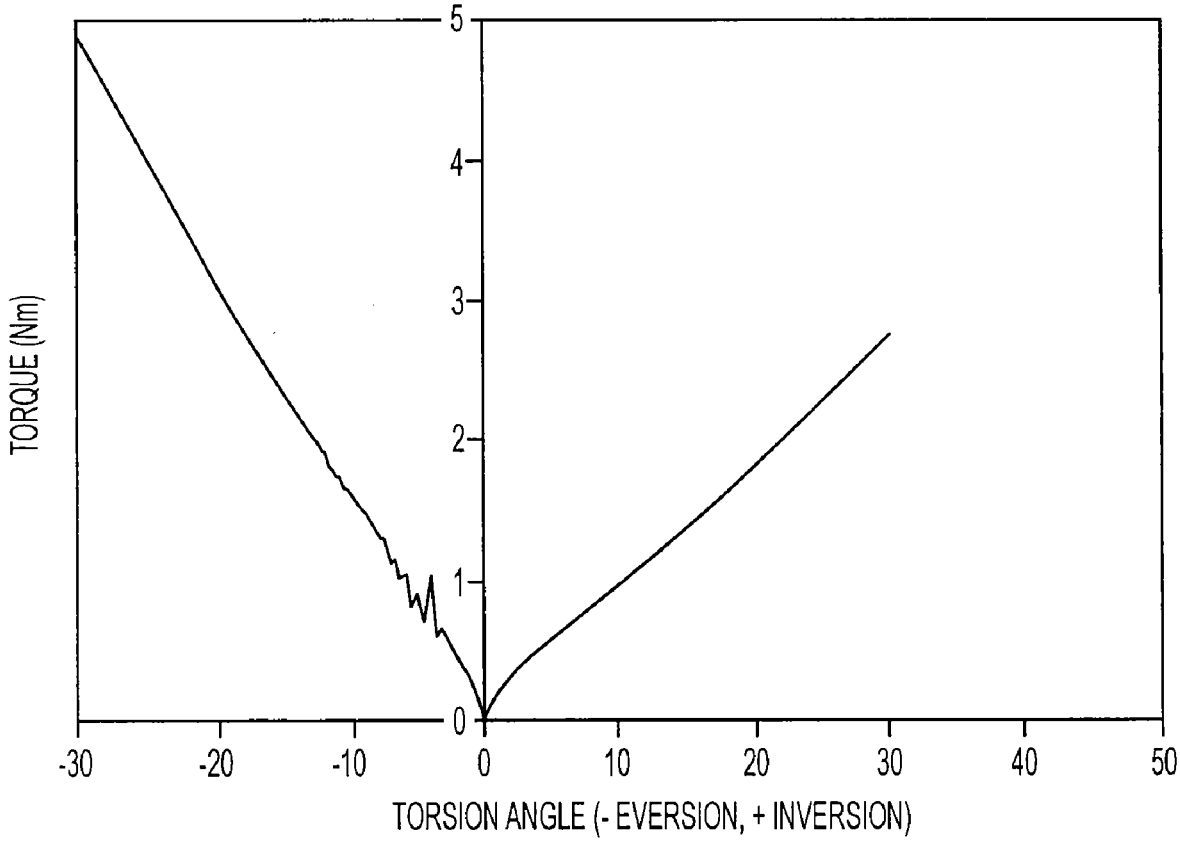

FIG. 38 is an exemplary torsion response profile for a torsion control element according to an embodiment of the present invention.

Figure 39:
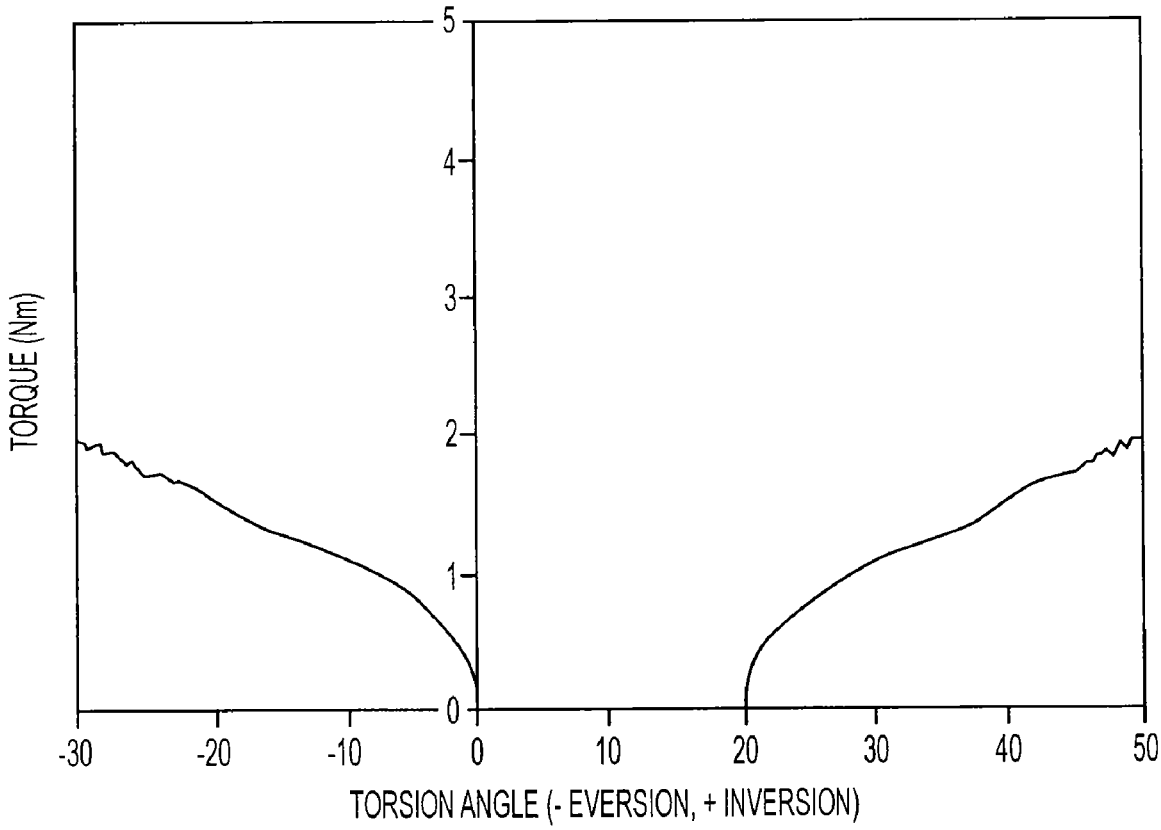

FIG. 39 is an exemplary torsion response profile for a torsion control element according to an embodiment of the present invention

DETAILED DESCRIPTION OF THE INVENTION

The present invention will now be described in detail with reference to embodiments thereof as illustrated in the accompanying drawings. References to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

An embodiment of the present invention includes a torsion control element 100. As will be described in detail below, the torsion control element 100 may be disposed in an article of footwear 10 to provide desired torsional resistance in response to twisting forces acting on the article of footwear, and, correspondingly, the wearer's foot. The torsion control element may also provide desired bending stiffness in the longitudinal direction of the article of footwear 10.

Figure 1A:
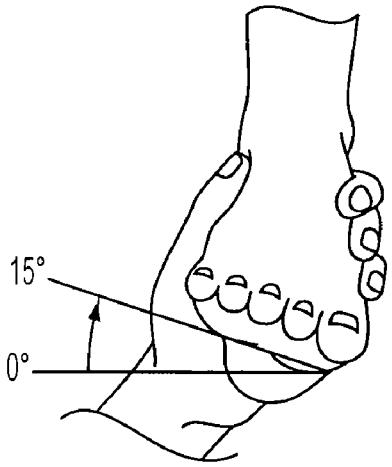
Figure 1B:
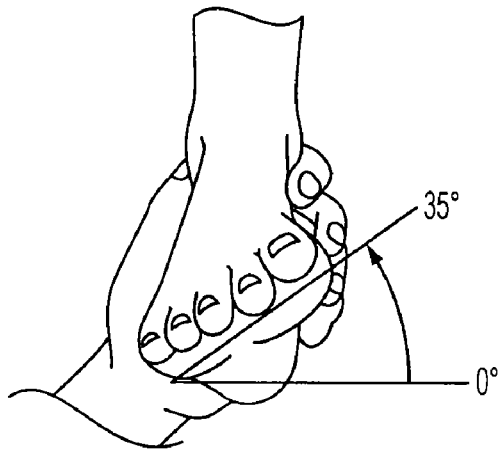

During physical activities, twisting forces acting on the foot may result in the forefoot of the wearer rotating relative to the rearfoot. As shown in FIG. 1*a*, the foot may articulate such that eversion of the foot occurs, resulting in the forefoot rotating outwardly relative to the rearfoot. As shown in FIG. 1*b*, the foot may also articulate such that inversion of the forefoot occurs, resulting in the forefoot rotating inwardly relative to the rearfoot. A right foot is shown; however, it will be apparent to one of ordinary skill in the art that a left foot undergoing similar forces may comprise a mirror image thereof.

As shown in FIGS. 1*a* and 1*b*, it may be desirable for an article of footwear to provide torsional resistance through a range of rotation of the foot. Accordingly, embodiments of the present invention may provide for torsion control through desired ranges of rotation of the foot. For example, embodiments of the present invention may provide less torsional resistance during typical forefoot eversion, which is in the range of 0 degrees to about 15 degrees relative to the heel, and in the range of 0 degrees to about 35 degrees relative to the heel during forefoot inversion. It is contemplated that embodiments of the present invention may also act on the rearfoot relative to the forefoot in an analogous manner. For example, in a running motion, during heel strike the rearfoot lands on the surface first while the forefoot typically rolls in a medial direction relative to the rearfoot before meeting the ground. This is opposite to push-off of the running motion, whereby the forefoot remains in contact with the ground surface while the rearfoot may be free to rotate relative to the forefoot.

In one embodiment of the present invention, the torsion control element 100 may be adapted to provide one level of resistance as the forefoot is subjected to a twisting force relative to the rearfoot in a first direction, and may be adapted to provide a second level of resistance as the forefoot is subjected to a twisting force relative to the rearfoot in a second direction. For example, the torsion control element 100 may be adapted to provide greater resistance to limit forefoot eversion and provide lesser resistance to limit forefoot inversion. It is contemplated that in some embodiments of the present invention the torsion control element 100 may be adapted to provide greater resistance in the forefoot inversion direction. In this manner, the torsion control element 100 may provide an asymmetrical resistance.

For example, during a physical activity in which the participant is required to plant the foot for quick cutting motions, like basketball, it may be desirable to provide less torsional resistance, and, thus, allow greater freedom of movement, in a particular direction. An embodiment of the torsion control element 100 may be incorporated in a basketball shoe such that it is adapted to provide greater torsional resistance in one direction to limit the sole from twisting and reduce injury, while providing less torsional resistance in the opposite direction to allow greater freedom of movement and improve traction and push-off. This may also provide improved leg alignment and/or a more natural movement of the foot.

In one embodiment of the present invention, the torsion control element 100 may be further adapted to provide little or no resistance until a predetermined point where resistance may be applied to prevent injury to the corresponding joints of the foot.

With reference to FIGS. 6 and 7, the torsion control element 100 may be disposed in the sole 20 of an article of footwear 10. Although the article of footwear 10 may be referred to herein as shoe 10, it is contemplated that it may comprise any type of footwear in which the control of torsion forces may be desirable, including, but not limited to, running shoes, basketball shoes, court shoes, tennis shoes, cleated footwear, and sandals.

In one embodiment, the sole 20 comprises a midsole of the shoe 10 and may provide stability and/or cushioning to the shoe. In one embodiment of the present invention, the sole 20 may comprise ethyl vinyl acetate (EVA). Other materials appropriate for the sole 20 including, but not limited to, polyurethane (PU), thermoplastic urethane (TPU), and thermoplastic rubber (TPR) are considered to be within the scope of the present invention.

As will be appreciated by those of ordinary skill in the art, the sole 20 may be formed around the torsion control element 100 using suitable molding, or other known techniques. In one embodiment of the present invention, the torsion control element 100 may be disposed in a cavity formed in the sole 20. In one embodiment of the present invention, the sole 20 may further include an outsole 40 and an upper 30 attached to the sole 20. The torsion control element 100 may be disposed in the sole 20 between the wearer's foot and the ground engaging surface (e.g., outsole 40). In some embodiments, the control element may be disposed as close to the foot as possible. In other embodiments, it is contemplated that the torsion control element may be disposed more proximate to the ground engaging surface.

Figure 2:
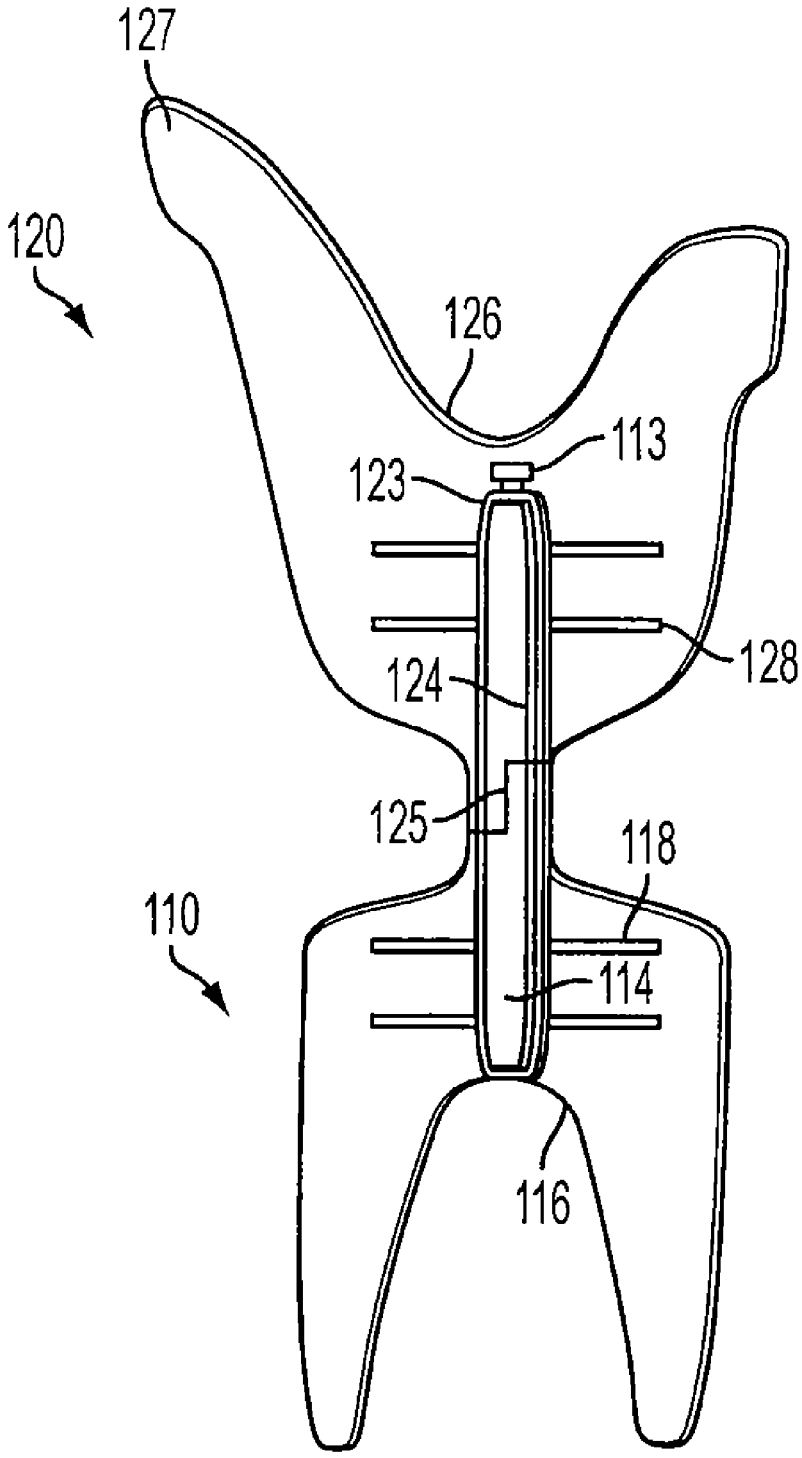
FIG. 2 is a bottom view of a torsion control element according to an embodiment of the present invention.
Figure 3:
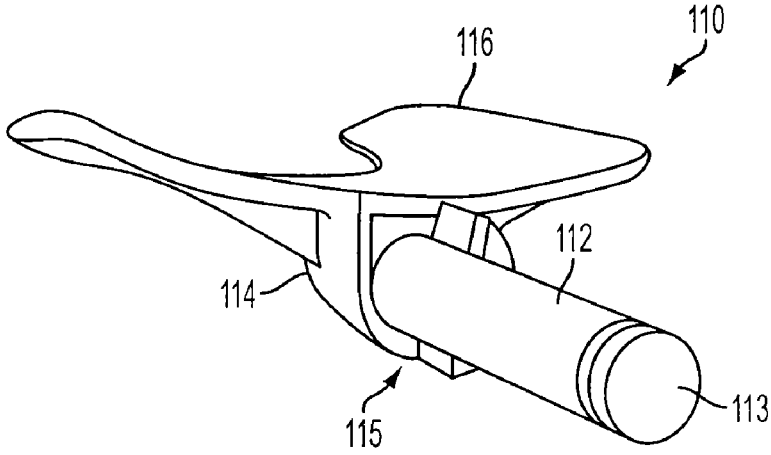
FIG. 3 is a perspective view of a first portion of a torsion control element according to an embodiment of the present invention.
Figure 4:
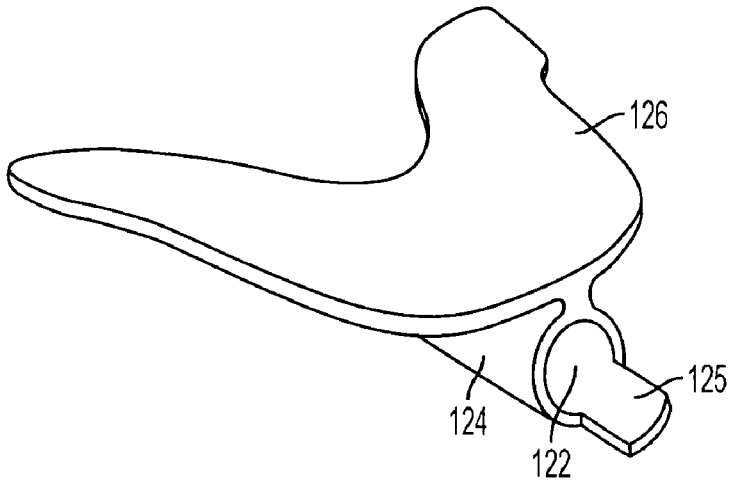
FIG. 4 is a perspective view of a second portion of a torsion control element according to an embodiment of the present invention.

With reference to FIGS. 2-4, in one embodiment, the torsion control element 100 includes a first member 110 operatively connected to a second member 120. The first member 110 may be disposed in the rearfoot portion of the footwear and the second member 120 may be disposed in the forefoot portion. The first member 110 may include a shaft 112 extending from a hub 114 portion of a base 116. In one embodiment of the present invention, the shaft 112 may be cylindrical in shape; however, it is contemplated that other suitable shapes for the shaft 112, including, but not limited to, hexagonal, and/or polygonal may be used.

The second member 120 may include a bore 122 for receiving the shaft 112 of the first member 110. The bore 122 is formed in a hub 124 portion of a base 126. One or more support elements 118 may be formed in the base 116 and connected to the hub 114 to provide additional desired torsional stiffness and/or stability to the torsion control element 100. Similarly, one or more support elements 128 may be formed in the base 126 and connected to the hub 124 to provide additional desired torsional stiffness and/or stability to the torsion control element 100. When the torsion control element 100 is disposed in an article of footwear, the bore and shaft may be arranged below the bases 116 and 126 such that the bases distribute the load of the wearer rather than that load being on the shaft 112.

The bases 116 and 126 may have a gradually curved shape such that the upper surface of each is shaped to conform to the bottom of the foot of the wearer. In one embodiment of the present invention, the base 126 may comprise a generally Y-shape. As shown in FIG. 2, a support arm 127 may extend from the base 126 on one side of the torsion control element 100. The support arm 127 may assist in distribution of the load such that the device does not move within the sole of the footwear, which may be made of a relatively soft material. In some embodiments, the support arm 127 also may provide additional desired torsional resistance to the wearer and may provide stability to the shoe. In one embodiment of the present invention, the base 116 may comprise a U-shape. It is contemplated that other shapes for the bases 116 and 126 are considered to be within the scope and spirit of the present invention.

In one embodiment of the present invention, as shown in FIG. 2, the end of the shaft 112 may extend beyond an opening 123 in the hub 124 of the second member 120. A stopper 113 may be connected to the end of the shaft 112 such that the shaft may be prevented from withdrawing from the bore 122 during use. The stopper 113 may comprise an element formed as part of the shaft 112 having a cross-width greater than the opening 123, an O-ring disposed in a groove at the end of the shaft, or other suitable means, such as, for example, a snap ring or washer, for preventing withdrawal of the shaft 112 from the bore 122.

The torsion control element of the present invention may comprise any material adapted to provide the desired torsional resistance and/or to maintain the desired longitudinal bending stiffness from the forefoot portion to the rearfoot portion. In one embodiment of the present invention, the torsion control element may comprise one or more polyamides or other plastic materials such as polyether block amide (PEBA), thermoplastic polyurethane (TPU), reinforced materials (such as, for example, glass-fiber reinforced materials), metals, metal alloys, and/or suitable composite materials. In one embodiment, the torsion control element may comprise Pebax, a polyether block amide by Arkema, Inc. As will be apparent to those of ordinary skill in the art, other suitable materials, including, but not limited to, polyurethane, rigid plastics, and similar materials may be used. In alternative embodiments of the present invention in which reduced torsional resistance may be desired, more resilient materials, such as, for example, flexible plastics, rubber, silicone, neoprene, and similar materials may be used.

As best shown in FIGS. 3 and 4, a slot 115 may be formed in the hub 114 around the shaft 112 of the first member 110, and a corresponding resistance arm 125 may extend from the hub 124 of the second member 120. The resistance arm 125 may abut against the hub 114 in a first direction and may be adapted to rotate through the slot 115 in a second direction, until it subsequently abuts against the hub 114 at the end of the slot 115.

With reference to FIGS. 5*a* and 5*b*, operation of the torsion control element 100 will now be described. As shown in FIG. 5*a*, the resistance arm 125 may abut against the hub 114 of the first member when the torsion control element 100 is in a closed position (i.e., at rest and not subjected to torsional forces). As shown in FIG. 5*b*, when the torsion control element 100 is subjected to torsional forces in a first direction (e.g., in the direction of the arrow 101, resulting in forefoot inversion), the resistance arm 125 is adapted to freely rotate through the slot 115 around the shaft 112 for an initial range of rotation until the resistance arm 125 reaches the end of the slot. Because the resistance arm is free to rotate through the slot, the torsion control element 100 may provide little or no resistance against the rotation of the forefoot relative to the rearfoot in this direction during the initial range of motion. As the arm 125 rotates, the stopper 113 may prevent the shaft 112 from withdrawing from the bore.

As the forefoot is subjected to further twisting relative to the rearfoot, the resistance arm 125 continues to rotate through the slot 115. When the resistance arm 125 reaches the end of the slot 115, it abuts against the hub 114. At this point, the resistance arm 125 is no longer free to rotate in the slot 115, and, depending on the magnitude of the rotational forces acting on the torsion control element 100, the torsion control element 100 may begin to twist. As the torsion control element 100 twists, it provides resistance against further rotation in this direction. The level of resistance provided may be dependent, for example, on the elastic properties of the torsion control element 100, its size, and/or its shape. For example, in embodiments of the present invention in which the torsion control element 100 comprises a rigid plastic, the device may provide greater resistance than if the device were made of a more flexible material. The size, shape, and/or material used for the torsion control element 100 may be adapted to provide the desired level of resistance for the article of footwear 10.

When the torsion control element 100 is subjected to torsional forces in a second direction (e.g., in the direction opposite the arrow 101, resulting in forefoot eversion), the resistance arm 125 immediately abuts against the hub 114. Depending on the magnitude of the forces, the torsion control element 100 may begin to twist and provide resistance against further rotation in this direction. In this manner, the torsion control element 100 may be adapted to abruptly resist torsion in the second direction. In addition, the torsion control element 100 may provide a different level of resistance in opposite directions of forefoot rotation relative to the rearfoot.

In one embodiment of the present invention, the torsion element 100 may be adapted to allow rotation of the forefoot relative to the rearfoot through a range of motion in two directions. For example, the resistance arm 125 may be positioned within the slot 115 intermediate both ends of the slot when the torsion control element is not subjected to torsional forces. In this manner, when it is subjected to torsional forces in either direction (i.e., resulting in either inversion or eversion), the resistance arm 125 may freely rotate in the slot for a portion of the rotation. When the resistance arm 125 subsequently abuts the hub 114, the torsion control element may then provide resistance against further rotation. This may be provided in an article of footwear in which rotation without torsion resistance in both directions may be desirable. For example, some embodiments of a cross-country or trail-running shoe including the torsion control element 100 may allow a degree of inversion and eversion of the foot so that the user may traverse uneven surfaces.

In embodiments of the present invention, the size of the slot 115 may be adjusted depending on the torsion resistance needs of the article of footwear. For example, the slot 115 may be lengthened or shortened so that the resistance arm 125 may freely rotate in the slot for a greater or lesser range of motion. In this manner, rotation of the forefoot relative to the rearfoot in the inversion direction may be provided without resistance for a greater or lesser range of motion.

In one embodiment, the length of the shaft 112 may be varied to provide the desired torsional stiffness. For example, the torsional stiffness of a cylindrical shaft 112 is inversely proportional to its length and is defined by equation 1 below:

$$T=(AGJ)/L \qquad \text{Eq. 1,}$$

where T is the amount of torque or torsional resistance provided, L is the length of the shaft, G is a modulus of rigidity, J is a polar area moment of inertia, and A is the angle of twist. Accordingly, the torsion control element 100 may, for example, be provided with shorter shaft to provide a greater level of resistance against twisting forces.

With reference to FIG. 7, the first member 110 is shown at least partially disposed in the rearfoot of the shoe 10 and the second member 120 is shown at least partially disposed in the forefoot of the shoe 10. The positioning of the torsion control element 100 in FIG. 7 is meant to be illustrative only, and not limiting. It is contemplated that the torsion control element 100 may be positioned in the sole 20 to provide the desired torsion resistance for the shoe 10 and its intended use. It is further contemplated that the first member 110 may be in the rearfoot and the second member 120 may be in the forefoot of the shoe 10.

In one embodiment of the present invention, the torsion control element 100 may be positioned substantially along the clinical axis of the foot, which approximates the motion of a combination of joints in the foot which allow the foot to move. The clinical axis may correlate with the longitudinal axis 21 extending from the rearfoot portion of the sole 20 to the forefoot portion. The torsion control element 100 may rotate about the axis 21 when it is subjected to rotational forces. In alternative embodiments, the torsion control element 100 may be positioned transversely in either direction from the longitudinal axis 21.

In one embodiment of the present invention, as shown in FIG. 8, the torsion control element 100 may be visible through a window 23 formed in the sole 20. The torsion control element 100 may also be accessed by the user through the window 23. In this manner, the user may access a lever (not shown) or other adjustment means to manually adjust the level of resistance provided by the device. For example, the wearer may manually adjust the effective length of the shaft 112, or the position of the resistance arm 125 within the slot 115.

Another embodiment of the torsion control element of the present invention is shown in FIGS. 9 and 10, in which like reference numerals refer to like elements. The torsion control element 200 includes a first member 210 operatively connected to a second member 220. The first member 210 includes a shaft 212 extending from a hub 214 portion of a base 216. A ridge 218 is formed at the end of the shaft 212 and extends longitudinally along the shaft. The second member 220 includes a bore 222 for receiving the shaft 212 of the first member 210. The bore 222 is formed in a hub 224 portion of a base 226. A notch 225 for receiving the ridge 218 is formed along the length of the bore 222.

The torsion control element 200 is adapted to operate substantially as described above in connection with torsion control element 100. The ridge 218 may abut against an interior surface of the notch 225 when the torsion control element 200 is not subjected to torsional forces. During use, when the torsion control element 200 is subjected to torsional forces in a first direction (e.g., inversion), the ridge 218 is adapted to freely rotate in the notch 225. When the ridge 218 abuts the opposite interior surface of the notch 225, it is no longer free to rotate and the torsion control element 200 will provide resistance against further rotation in this direction. When the torsion control element 200 is subjected to torsional forces in a second direction (e.g., eversion), the ridge 218 immediately abuts against the interior surface of the notch 225 and the torsion control element 200 provides resistance against further rotation in this direction.

The length and width of the ridge 218 may be varied to provide the desired level of torsional resistance. For example, in one embodiment, the ridge 218 may be lengthened along the shaft 212 to provide increased torsional stiffness. In one embodiment, the width of the ridge 218 may be narrowed, or similarly, the notch 225 may be widened, such that rotation of the forefoot relative to the rearfoot in one direction (e.g., inversion) may be provided without resistance for a greater range of motion. As discussed below, a bushing or bearing or the like may be disposed at the connection of the first member 210 and the second member 220. The bushing may be used to facilitate and/or control the rotation of one member relative to the other, and/or increase durability of the torsion control element.

Another embodiment of the torsion control element of the present invention is shown in FIGS. 11-13. The torsion control element 300 includes a first member 310 operatively connected to a second member 320. The first member 310 includes a base 312 having a plurality of ridges 314 formed thereon at an angle relative to the longitudinal axis of the sole 20. In one embodiment, the ridges 314 may be formed at an angle in the range of from about 30 degrees to about 50 degrees relative to the longitudinal axis. The exact angle may vary depending on the geometry of the shoe.

The second member includes a base 322 and a plurality of openings 324 formed therein. The openings 324 are adapted to receive the ridges 314 in a snug fit and are formed at the same angle relative to the longitudinal axis 21 (not shown) of the sole 20. The size and number of ridges 314 and openings 324 may vary depending on the torsion resistance needs of the control element 300. For example, the number and width of the ridges 314 may be increased to provide more torsional stiffness.

The bases 312 and 322 may have a gradually curved shape such that the upper surface of each is shaped to conform to the bottom of the foot of the wearer. In one embodiment of the present invention, lateral support arms 316 and 326 extend from the lateral side of bases of the first and second members 310 and 320 and are adapted to wrap up the lateral side of the foot for additional support. The first member 310 may further include a stability arm 318 extending from the base 312 on the medial side and/or on the lateral side. In one embodiment, as shown in FIG. 36, the torsion element 300 may include two stability arms 302 extending in the forefoot direction and two stability arms 304 extending in the heel direction such that the torsion element comprises two y-shaped ends.

When operatively connected, the second member 320 is disposed on top of the first member 310. In one embodiment of the present invention, an adhesive or other means for securing all or a portion of the first member to the second member, may be used. When used, the adhesive is applied so as not to deteriorate the operating capabilities of the torsion control element 300 and, in one embodiment, may have elastic properties.

The torsion control element 300 is adapted to provide desired resistance to torsion forces substantially as described above in connection with previous embodiments. During use, when the torsion control element 300 is subjected to torsional forces in a first direction (e.g., inversion), the second member 320 may be brought into tension such that the openings 324 expand slightly, and thereby permitting some bending of the device. Although the torsion control element 300 may bend, it may still provide resistance against the forces. The level of resistance provided may be dependent, for example, on the elastic properties of the torsion control element 300, its size, and/or its shape. In one embodiment, the torsion control element 300 may be adapted to bend or rotate about an underfoot area rather than a particular axis of rotation, and, thus, may simulate the natural mechanics of the foot.

When the torsion control element 300 is subjected to torsional forces in a second direction (e.g., eversion), the second member may be under compression such that the openings 324 constrict. As a result, the torsion control element 300 may be more resistant to bending, and, correspondingly, may provide greater resistance against rotation of the device.

In one embodiment of the present invention, as shown in FIGS. 34 and 35, the second member 320 may include a forefoot extension 328 extending in the forefoot portion of the sole 20 and a toe extension 329 extending from the forefoot extension 328 under the toe-off area of the foot. The toe extension 329 may provide additional stiffness and/or stability to the foot during toe-off. The forefoot extension 328 may also include a plurality of openings 324 for receiving ridges 314. In one embodiment of the present invention, the second member 320 may be formed of a more rigid material than the first member 310 to provide the desired bending, and corresponding torsional stiffness, of the control element 300.

Another embodiment of the torsion control element of the present invention is shown in FIGS. 14 and 15. The torsion control element 400 includes a first member 410 operatively connected to a second member 420. The first member 410 includes a plurality of prongs 414 extending from a base 412 at an angle relative to the longitudinal axis 21 (not shown) of the sole 20. Similarly, the second member includes a plurality of prongs 424 extending from a base 422 which are adapted to interface with the prongs 414 and form the torsion control element. Each of the bases 412 and 422 may include recesses 416 and 426 to receive the corresponding prongs. It is contemplated that the size and number of the prongs 414 and 424 may vary depending on the torsion resistance needs of the control element 400. The bases 412 and 422 may have a gradually curved shape such that the upper surface of each is shaped to conform to the bottom of the foot of the wearer.

When operatively connected, the second member 420 is disposed on top of the first member 410. In one embodiment of the present invention, an adhesive or other means for securing all or a portion of the first member to the second member, may be used. When used, the adhesive is applied so as not to deteriorate the operating capabilities of the torsion control element 400 and, in one embodiment, may have elastic properties.

The torsion control element 400 is adapted to provide desired resistance to torsion forces substantially as described above in connection with previous embodiments. During use, when the torsion control element 400 is subjected to torsional forces in a first direction (e.g., inversion), the device is put into tension and the prongs may be permitted to bend, thereby allowing some bending of the device. Although the torsion control element 400 may bend, it may still provide resistance against the torsional forces. When the torsion control element 400 is subjected to torsional forces in a second direction (e.g., eversion), the device is under compression such that the prongs are more resistant to bending, and, correspondingly, may provide greater resistance against rotation of the device.

Another embodiment of the torsion control element of the present invention is shown in FIGS. 16 and 17. The torsion control element 500 includes a plurality of support members 512 extending across and secured at each end to a base 510 which forms a perimeter of the control element. A plate 514 is connected to each support member 512 such that the plates 514 are closely fit adjacent one another. When the base 510 is placed under tension, the plates 514 are adapted to separate such that a gap is formed between each plate until the base 510 prevents further separation. The support members 512 and the plates 514 may be formed at an angle relative to the longitudinal axis of the sole. In one embodiment, the torsion control element 500 forms a unitary device; however, it is contemplated that the support members 512 and/or plates 514 may be separate elements that are operatively connected.

The torsion control element 500 is adapted to provide desired resistance to torsion forces substantially as described above in connection with previous embodiments. As shown in FIG. 18*a*, the plates 514 may abut against each other when the torsion control element 500 is at rest and not subjected to torsional forces in a first direction. As shown in FIG. 18*b*, when the torsion control element 500 is subjected to forces in a first direction that place the device in tension, the plates 514 are adapted to separate, thereby allowing the torsion control element 500 to bend in response to the applied forces. As the device bends, it may provide some resistance against the torsional forces. When the torsion control element 500 is subjected to forces in a second direction whereby the device is put into compression, the plates 514 immediately abut against each other rather than separate. In this manner, the torsion control element 500 may be adapted to abruptly resist torsion in the second direction.

Another embodiment of the torsion control element of the present invention is shown in FIG. 19. One or more grooves 22 may be formed in the sole 20 of the shoe 10. The grooves may be formed at an angle relative to the longitudinal axis of the sole. In one embodiment, the grooves may extend from the medial side of the sole to the lateral side. However, it is contemplated that in alternative embodiments the grooves 22 may not extend across the width of the sole 20. When the sole 20 is subjected to torsional forces in a first direction, the sole is placed in tension. As a result, the grooves 22 are adapted to separate, and thereby permit rotation of the sole. Depending on its material composition, even as the sole 20 rotates, the sole may provide some resistance to the rotation. When the sole 20 is subjected to torsional forces in a second direction, the sole 20 is placed under compression and the grooves 22 are adapted to close, thereby providing greater resistance to the twisting forces acting on the sole in this direction.

The grooves 22 may be positioned within a zone of the sole 20 to provide the desired level of torsional resistance. As shown in FIG. 19, this torsional resistance zone may be provided between a distance L1 from the heel of the sole 20 and a distance L2 from the heel. In one embodiment, the grooves 22 may be positioned within a zone ranging from a distance L1 approximately 30% of the length of the sole 20 from the heel to a distance L2 approximately 50% of the length of the sole 20 from the heel. The grooves may also be positioned in the sole 20 at an angle Θ, as shown in FIG. 19, to provide the desired level of torsional resistance. In one embodiment, the grooves 22 may be positioned at angle Θ of approximately 52.5 degrees.

In one embodiment of the present invention, the upper 30 of the shoe 10 may work in combination with the torsion control elements described herein to control the level of resistance to torsion forces between the forefoot and the rearfoot. In one embodiment, as shown in FIG. 20, a portion of the upper 30 may include a stretchable region 32. The stretchable region 32 may be made of a material having desired elastic properties, including, but not limited to, spandex or other suitable stretchable materials. Because of its elastic properties, the stretchable region 32 may be adapted to enable increased rotation of the forefoot relative to the rearfoot and provide increased freedom of movement in one or more directions.

The stretchable region 32 may be disposed on the lateral side or the medial side of the shoe 10. In one embodiment of the present invention, as shown in FIG. 21, the stretchable region 32 may be disposed on both the lateral side and the medial side of the shoe 10, each region being connected to the other via a stretchable bridge region 34 disposed across the instep of the shoe.

As shown in FIGS. 22 and 23, in one embodiment of the present invention, the upper 30 may include one or more straps 36 and 38 which may be integrated with the upper to supplement the level of resistance to torsion forces between the forefoot and the rearfoot. In one embodiment, the upper 30 may include a lateral strap 36 extending from the medial side of the shoe 10 to the lateral side of the shoe, or a medial strap 38 extending from the lateral side to the medial side of the shoe. The straps may be secured to the upper by attachment means, such as, for example, hook and loop, or the like. In this manner, the strap may resist torsion in a first direction when subjected to forces that place the strap in tension, and may provide increased freedom of movement in a second direction when subjected to forces that place the strap under compression. In another embodiment, as shown in FIG. 23, both straps may be used. The straps 36 and/or 38 may be used in conjunction with the torsion control element and/or the stretchable regions 32 and/or 34.

As shown in FIG. 24, in another embodiment of the present invention, the upper 30 may include a plurality of parallel flex lines 31 formed thereon. The flex lines 31 may be formed on the upper 30 by laser cutting, or other known techniques. The lines may be adapted to allow flexibility of the upper 30 in one direction, but provide resistance in the opposite direction. The flex lines 31 may also provide ventilation to the upper.

In one embodiment, the upper 30 may include a construction whereby the medial and lateral sides have different flexibility characteristics, including constructions as disclosed in U.S. Pat. No. 6,108,943 to Hudson et al., the disclosure of which is incorporated herein by reference thereto. Other constructions, including those disclosed in U.S. patent application Ser. No. 10/547,645 to Nishiwaki et al., published as United States Published Application No. 2006/0162190, the disclosure of which is incorporated herein by reference thereto, are considered to be within the scope and spirit of the present invention.

Another embodiment of the torsion control element of the present invention is shown in FIG. 25. The torsion control element 600 may include a first torsion rod 610 disposed parallel to a second torsion rod 620. The first and second torsion rods may be disposed in the sole 20 of a shoe parallel to the longitudinal axis of the sole. The first torsion rod 610 may include a forefoot end 612 and a rearfoot end 614, and the second torsion rod 620 may include a forefoot end 622 and a rearfoot end 624. In one embodiment, at least a portion of the first and/or second torsion rod is disposed in the forefoot portion of the sole and at least a portion is disposed in a rearfoot portion of the sole. The torsion rods may extend the same distance in the forefoot and rearfoot directions, or, alternatively, one torsion rod may extend further than the other. For example, a first torsion rod 610 disposed on the medial side of the sole 20 may extend further than the second torsion rod 620, so as to provide increased stiffness under the toe-off area of the foot. As the forefoot is subjected to torsional forces relative to the rearfoot, the first and second rods may provide resistance against the twisting forces.

As described above, the torsion control element 600 may comprise any material adapted to provide the desired torsional resistance and/or to maintain the desired longitudinal bending stiffness from the forefoot portion to the rearfoot portion. In one embodiment of the present invention, the torsion control element may comprise one or more polyamides or other plastic materials such as polyether block amide (PEBA), thermoplastic polyurethane (TPU), reinforced materials (such as, for example, glass-fiber reinforced materials), metals, metal alloys, and/or suitable composite materials. In one embodiment, the torsion control element may comprise Pebax, a polyether block amide by Arkema, Inc. As will be apparent to those of ordinary skill in the art, other suitable materials, including, but not limited to, polyurethane, rigid plastics, and similar materials may be used. In alternative embodiments of the present invention in which reduced torsional resistance may be desired, more resilient materials, such as, for example, flexible plastics, rubber, silicone, neoprene, and similar materials may be used.

In one embodiment, as shown in FIG. 25, the torsion rods may be connected by a connecting member 630. The length of the connecting member 630, and, correspondingly, the distance between the first torsion rod 610 and the second torsion rod 620 may be varied depending on the desired resistance. For example, the connecting member 630 may be shortened, and, thus, the first and second torsion rods may be disposed closer together, to provide increased torsional resistance. In embodiments of the present invention, the longitudinal position of the connecting member 630 may also be varied to provide the desired torsional resistance. For example, placement of the connecting member 630 closer to the forefoot ends of the torsion rods may provide increased resistance against twisting of the forefoot relative to the rearfoot. As the connecting member 630 is placed closer to the rearfoot end of the torsion rods, the resistance against twisting of the forefoot relative to the rearfoot may be reduced.

In one embodiment of the present invention, the resistance provided by the torsion control element 600 may be selectively controlled by the wearer. As shown in FIG. 26, the connecting member 630 may be slidably attached to a track 616 formed longitudinally in each torsion rod. Locking means (not shown) may be provided along the track 616 for locking the connecting member 630 into the desired position. A lever (not shown), or other suitable means for moving the connecting member 630 within the track may be provided on the outside of the shoe for access by the wearer. In this manner, the wearer may selectively adjust the resistance provided. The size, shape, location, and/or materials of the torsion control element 600 may be adapted to provide the desired torsional resistance and desired longitudinal bending characteristics.

Another embodiment of the torsion control element of the present invention is shown in FIG. 27. The torsion control element 700 includes a main body 710 disposed in a lateral portion of the sole 20. A forefoot wing 712 extends from one end of the main body 710 and a rearfoot wing 714 extends from the opposite end of the main body. The main body 710, the forefoot wing 712 and the rearfoot wing 714 work together to provide resistance against torsion forces acting on the foot.

The size, shape, thickness, position within the sole 20, and/or the material(s) of the torsion control element 700, for example, may be adapted to provide the desired torsional resistance and desired longitudinal bending characteristics. In one embodiment, the main body 710 and each wing are formed of the same material. In an alternative embodiment, the main body 710 is formed of a different material than the forefoot wing 712 and/or the rearfoot wing 714. For example, the main body 710 may comprise a more rigid material than the forefoot wing and the rearfoot wing so as to provide increased resistance with respect to rotation of the foot in a particular direction (e.g., eversion). In one embodiment, as shown in FIG. 28, the main body 710 may include a plurality of elongated members 715 disposed in a cavity 711 formed in the main body. The elongated members 715 may comprise a material having different elastic properties than the main body 710 in order to provide desired torsion resistance.

Another embodiment of the torsion control element of the present invention is shown in FIG. 29. The torsion control element 800 includes forefoot member 810, a medial member 820, and a lateral member 830 connected at joints 840 to form a generally triangular torsion control element disposed in a sole 20. The size, shape, thickness, position within the sole 20, and/or the material(s) of the torsion control element 800 may be adapted to provide the desired torsional resistance and desired longitudinal bending characteristics. For example, the joints 840 may comprise a different material (e.g., a more flexible material) than the forefoot member 810, the medial member 820, and/or the lateral member 830 to provide desired torsional resistance.

Another embodiment of the torsion control element of the present invention is shown in FIGS. 30 and 31. The torsion control element 900 may be disposed in the sole 20 and includes a main body 910 formed around a torsional spring 920. The spring 920 may be adapted to resist torsional forces in one or more directions. In one embodiment, the spring 920 may be adapted to allow rotation of the sole 20 in a first direction (e.g., inversion) and resist rotation of the sole 20 in a second direction (e.g., eversion). The spring constant, size, shape, thickness, position within the sole 20, and/or the material(s) of the main body 910 and/or the spring 920 may be adapted to provide the desired torsional resistance and desired longitudinal bending characteristics.

Another embodiment of the torsion control element of the present invention is shown in FIG. 32. The torsion control element 1000 includes a first member 1010 operatively connected to a second member 1020 and disposed in the sole 20. The first member 1010 extends from the lateral rearfoot portion of the sole to a medial forefoot portion, and the second member 1020 extends from a medial rearfoot portion of the sole to a lateral forefoot portion. The first member 1010 is operatively connected to the second member 1020 at the intersection joint 1015 by a band 1030. The band 1030 may allow flexing of the first member 1010 and the second member 1020 about the intersection joint 1015.

The location of the intersection joint 1015 may be varied depending on the desired torsional resistance. The location may be varied during production or by a user by an adjustment means, such as, for example, a lever (not shown). For example, the intersection joint 1015 may be located closer to the forefoot portion of the sole 20 to provide increased torsional resistance against rotation of the forefoot relative to the rearfoot, or may be moved closer to the rearfoot portion to allow increased rotational freedom of movement. The size, shape, thickness, position within the sole 20, and/or the material(s) of the first member 1010, the second member 1020 and/or the band 1030 may be adapted to provide the desired torsional resistance and desired longitudinal bending characteristics.

In embodiments of the present invention, the resistance provided by the torsion control element may be selectively controlled by the user. Adjustment means may be operatively connected to the torsion control element and may be accessible by the user such that the user may manually adjust one or more properties of the torsion control element to provide the desired torsional resistance and/or the desired longitudinal bending characteristics of the shoe. In this manner, a user may, for example, increase the torsion resistance in the shoe during an activity like basketball, and reduce the resistance during an activity like running. In addition, the same shoe model may be individually tuned for a particular user based on the user's age, size, gender, or other personal attributes.

In other embodiments of the present invention, the torsion control element 100 may be disposed in an "intelligent" shoe system 10 such that the torsion control element may be dynamically manipulated to provide the desired torsional resistance depending on the needs and/or environment of the user. In one embodiment, as shown in FIG. 33, a control system 50 including a microprocessor 52 and a sensor 54 may be operatively connected to the torsion control element 100. The sensor 54 may detect a value for one or more performance conditions, such as, for example, torsion forces or compression forces acting on the shoe 10, the angle or position of the foot as it strikes the ground, the angle or position of the foot during toe-off, and/or other performance conditions that the user may wish to monitor.

As the sensor 54 detects a value for the monitored condition, instructions stored in the microprocessor 52 may indicate the desired reaction to the condition by the torsion control element 100. For example, if the sensor 54 detects a foot position that indicates an overpronation of the foot is occurring, the microprocessor 52 may determine that an increase in resistance against rotation of the forefoot relative to the rearfoot in the eversion direction is required.

The microprocessor may then communicate instructions to a torsion control element actuation means 102, which, in turn, actuates an adjustable element 103 in the torsion control element 100 such that resistance is increased. The actuation means 102 may comprise mechanical, electromechanical, hydraulic, or other suitable means for actuating the adjustable element 103. By way of illustration only and not limitation, with reference to the embodiment of the torsion element shown in FIG. 26, the actuation means 102 may be operatively connected to the connecting member 630 and may move the connecting member 630 to a more forward position within the track 616 to provide the desired increased resistance. A feedback loop 60 may update the control system 50 with information about the current state of the torsion control element 100, and the performance conditions of the shoe may be continually monitored.

In one embodiment, a power source 70, such as, for example, a battery may be operatively connected to the system 10. The power source 70 may be disposed in or on the shoe, may be removable from the shoe, or may be an external power source that selectively connects to the system. In one embodiment, a user interface 80 may be operatively connected to the system 10. The user interface 80 may be used to select a desired operation mode (e.g., a running mode with less resistance or a basketball mode with more resistance), or input desired instructions to the microprocessor 80. The user interface 80 may also provide output of certain data or conditions to the user. As will be appreciated to those of ordinary skill in the art, other features of an "intelligent" shoe system may be incorporated, including those disclosed in, for example, U.S. Pat. No. 7,188,439 to DiBenedetto et al., the disclosure of which is incorporated herein by reference thereto.

It is contemplated that a torsion control element according to an embodiment of the present invention may be provided in one or both of a pair of shoes. In an embodiment of the present invention, a pair of shoes may be provided having a torsion control element with different resistance properties in each shoe. In one embodiment, a first shoe may provide greater torsional resistance than a second shoe. For example, a runner on a track may desire more resistance in the lateral side of their right shoe and/or the medial side of their left shoe to help them maintain their lane on a curved track. By way of further example, a golfer, a baseball pitcher, or a football place kicker may desire less resistance in their free-swinging foot than required in their plant foot.

It is further contemplated that embodiments of the torsion control element may be utilized to control torsion in other areas of the shoe 10 including the upper, as shown in U.S. Pat. No. 6,715,218 to Johnson, the disclosure of which is incorporated herein by reference thereto.

Another embodiment of the torsion control element of the present invention is shown in FIG. 37*a* and 37*b*. The torsion control element 1100 includes a heel plate 1110 disposed in the heel portion of the sole 20 which is operatively connected to a forefoot member 1120. A bushing 1122 may be disposed at the connection of the heel plate 1110 and the forefoot member 1220. The bushing 1122 may be made of metal, plastic, or other suitable material, and may be used to facilitate and/or control the rotation of one member relative to the other, and/or increase durability of the torsion control element. In alternative embodiments, a bearing or the like may be used in place of the metal bushing. The underside of the sole 20 may include an opening 24 to receive the bushing 1122 and permit rotation of the forefoot member 1220 relative to the heel plate 1110.

With reference to FIG. 38, an exemplary torsion response profile, in which resistance is a function of the rotational angle, for a torsion control element 300 according to an embodiment of the present invention will now be described. As discussed above, the torsion control element may be adapted to provide a first resistance level in one direction (e.g., eversion) and a second resistance level in a second direction (e.g., inversion). For example, as shown in FIG. 38, a greater resistance level may be provided in the eversion direction. When the torsion control element 300 is subjected to torsional forces in the eversion direction, the second member may be under compression such that the openings 324 (as shown, for example, in FIG. 13) constrict. As a result, the torsion control element 300 may be more resistant to bending, and, correspondingly, may provide greater resistance against rotation of the device.

As shown in FIG. 38, in embodiments of the present invention, the torsion control element may further be adapted to provide a torsion response profile in which the slope of the curve is substantially uniform throughout the entire range of torsion angle in a particular direction. In this manner, the torsion control element may provide a gradual increase in resistance throughout the entire range of torsion angle in a particular direction.

FIG. 38 is intended to be exemplary only, and, as discussed above, the level of resistance provided (and, correspondingly, the shape of the curve illustrated) may be adapted to particular needs and may be dependent, among other things, on the elastic properties of the torsion control element, its size, and/or its shape. Although FIG. 38 illustrates a torsion response profile for an embodiment of the torsion control element 300, other embodiments of the torsion control element of the present invention may be adapted to provide a similar profile.

In other embodiments of the present invention, the torsion control element may be adapted to provide variable resistance levels in one or both directions of rotation. For example, the torsion control element may provide a first resistance level (which may be negligible resistance or none at all) in the inversion direction for a first range of rotation and a second resistance level in the inversion direction through a subsequent range of rotation. For example, FIG. 39 illustrates an exemplary torsion response profile for a torsion control element 200 having a ridge 218 according to one embodiment of the present invention, as shown for example in FIGS. 9 and 10. The shaft 212 may have a length of approximately 48 mm and a diameter of approximately 8 mm. The ridge 218 may have a length of approximately 38 mm, a width of approximately 3.8 mm, and may have a height of approximately 1.25 mm from the surface of the shaft. The ridge 218 may be offset from top-dead-center of the shaft 212 by approximately 10 degrees.

As shown in FIG. 39, in the inversion direction, little or no torsional resistance may be provided through an initial rotational range of approximately 20 degrees as the ridge 218 rotates freely within the notch 225. Subsequently, as the ridge 218 abuts the interior surface of the notch, the resistance provided may increase according to the non-linear relationship illustrated. In this manner, the resistance provided may abruptly increase as the slope of the resistance curve increases sharply at approximately 20 degrees to approximately 25 degrees in the inversion direction. In some embodiments, as shown in FIG. 39, at this point the slope may become substantially uniform such that a gradual resistance increase is provided after the initial abrupt increase in resistance.

In the eversion direction, as the ridge 218 may immediately abut against the interior surface of the notch 225, the torsion control element may immediately provide a resistance level according to the non-linear relationship illustrated. In this manner, the resistance provided may abruptly increase as the slope of the resistance curve increases sharply at approximately 0 degrees to approximately 5 degrees in the eversion direction. In some embodiments, as shown in FIG. 39, at this point the slope may become substantially uniform such that a gradual resistance increase is provided after the initial abrupt increase in resistance.

FIG. 39 is intended to be exemplary only, and, as discussed above, the level of resistance provided (and, correspondingly, the shape of the non-linear relationship) may be adapted to particular needs and may be dependent, among other things, on the elastic properties of the torsion control element, its size, and/or its shape. Although FIG. 39 illustrates a torsion response profile for an embodiment of the torsion control element 200, other embodiments of the torsion control element of the present invention may provide a similar profile. In addition, the dimensions provided are intended to be exemplary only, and other embodiments of the torsion control element 200 may be used.

The present invention has been described above by way of exemplary embodiments. Accordingly, the present invention should not be limited by any of the above-described exemplary embodiments, but should be defined only in accordance with the following claims and their equivalences.

What is claimed is:

1. An article of footwear, comprising:

a sole having a forefoot portion and a rearfoot portion; and a torsion element disposed in said sole, said torsion element comprising:

a first member having a shaft and a slot formed around the shaft; and a second member including a bore for receiving the shaft and an extension adapted to rotate in the slot, wherein said torsion element allows the forefoot portion to rotate in a first direction relative to the rearfoot portion and restricts the degree of rotation of the forefoot portion relative to the rearfoot portion in a second direction.

2. The article of footwear according to claim 1, wherein said torsion element is configured to allow the forefoot portion to rotate relative to the rearfoot portion in a direction that corresponds to an inversion of the foot of a user wearing the article of footwear.

3. The article of footwear according to claim 1, wherein said torsion element is configured to restrict the degree of rotation of the forefoot portion relative to the rearfoot portion in a direction that corresponds to an eversion of the foot of a user wearing the article of footwear.

4. The article of footwear according to claim 1, wherein said torsion element is configured to abruptly restrict rotation in the second direction.

5. The article of footwear according to claim 1, wherein said torsion element is configured to gradually restrict rotation in the second direction.

6. The article of footwear according to claim 1, wherein the extension rotates in the slot when the forefoot portion is subjected to a rotational force relative to the rearfoot portion in a first direction and wherein the extension does not rotate in the slot when the forefoot portion is subjected to a rotational force relative to the rearfoot portion in a second direction.

7. The article of footwear according to claim 1, wherein said torsion element comprises a unitary piece.

8. The article of footwear according to claim 1, wherein the first and second members comprise a unitary piece.

9. The article of footwear according to claim 1, said sole having a longitudinal axis and wherein said torsion element is disposed in said sole along the longitudinal axis.

10. The article of footwear according to claim 1, wherein said torsion element comprises a polyamide material.

11. The article of footwear according to claim 1, wherein said torsion element is configured to restrict the degree of rotation in the second direction at least in part as a result of the extension of the second member abutting a surface of the first member.

12. An article of footwear, comprising:

a sole having a forefoot portion and a rearfoot portion, wherein a longitudinal axis runs between the forefoot portion and the rearfoot portion; and a torsion element disposed in said sole along the longitudinal axis, wherein said torsion element comprises: a shaft, and a bore for receiving the shaft, wherein said torsion element is configured to provide a greater level of resistance against rotation of the forefoot portion relative to the rearfoot portion in a first direction than in a second direction.

13. The article of footwear according to claim 12, further comprising a slot formed around the shaft and an extension formed in the bore adapted to rotate in the slot.

14. The article of footwear according to claim 13, wherein said torsion element is configured to provide resistance at least in part as a result of the extension of the bore abutting a surface of the shaft.

15. The article of footwear according to claim 12, wherein the shaft extends from a hub, wherein the bore includes an extension adapted to rotate about the shaft, and wherein said torsion element is configured to provide resistance at least in part as a result of the extension abutting the hub.

16. The article of footwear according to claim 12, wherein said torsion element is configured to provide a greater level of resistance against rotation of the forefoot portion relative to the rearfoot portion in a direction that corresponds to an eversion of the foot of a user wearing the article of footwear.

17. The article of footwear according to claim 12, wherein said torsion element is configured to provide a lesser level of resistance against rotation of the forefoot portion relative to the rearfoot portion in a direction that corresponds to an inversion of the foot of a user wearing the article of footwear.

18. The article of footwear according to claim 12, wherein said torsion element is configured to abruptly restrict rotation in the first direction.

19. The article of footwear according to claim 12, wherein said torsion element is configured to abruptly restrict rotation in the second direction.

20. The article of footwear according to claim 12, wherein said torsion element is configured to gradually restrict rotation in the second direction.

21. An article of footwear, comprising:

a sole having a forefoot portion and a rearfoot portion; and a torsion element disposed in said sole, said torsion element comprising:

a first member, and a second member configured to allow for relative motion with respect to the first member, wherein said torsion element is configured to provide a first level of resistance against rotation of the forefoot portion relative to the rearfoot portion through a first range of rotation in a first direction, followed by a second level of resistance against rotation through a subsequent range of rotation in the first direction, wherein said torsion element is configured such that the transition from the first level of resistance to the second level of resistance occurs at least in part as a result of a surface of the first member contacting a surface of the second member after relative motion between the first member and the second member.

22. The article of footwear according to claim 21, wherein the second member is configured to receive and rotate about the first member, and wherein said torsion element is configured such that the transition from the first level of resistance to the second level of resistance occurs at least in part as a result of a surface of the first member contacting a surface of the second member after relative rotation between the first member and the second member.

23. The article of footwear according to claim 22, wherein the first member includes a shaft and the second member includes a bore for receiving the shaft.

24. The article of footwear according to claim 23, further comprising a slot formed in the first member around the shaft and an extension formed in the second member adapted to rotate in the slot.

25. The article of footwear according to claim 24, wherein the surface of the second member that is configured to contact the surface of the first member is the extension of the second member.

26. The article of footwear according to claim 21, wherein the second level of resistance is greater than the first level of resistance.

27. The article of footwear according to claim 21, wherein the first level of resistance is substantially zero.

28. An article of footwear, comprising:

a sole having a forefoot portion and a rearfoot portion; and a torsion element disposed in said sole for providing resistance against rotation of the forefoot portion relative to the rearfoot portion, said torsion element comprising:

a first member, and a second member configured to allow for relative motion with respect to the first member, wherein said torsion element is configured such that the resistance provided abruptly increases through a first range of rotation in a first direction, followed by a gradual increase through a second subsequent range of rotation in the first direction wherein said torsion element is configured such that the transition from the resistance experienced through the first range of rotation to the resistance experienced through the second range of rotation occurs at least in part as a result of a surface of the first member contacting a surface of the second member after relative motion between the first member and the second member.

29. The article of footwear according to claim 28, wherein the first member includes a hub and a shaft extending from the hub, the second member includes a bore for receiving the shaft and an extension adapted to rotate about the shaft, and wherein said torsion element is configured so that the abrupt increase in resistance through the first range of rotation results at least in part from a surface of the extension abutting a surface of the hub.

30. The article of footwear according to claim 29, wherein said torsion element is configured so that the gradual increase in resistance through the second range of rotation results at least in part from the surface of the extension continuing to remain in contact with the surface of the hub as the relative force between the two surfaces increases.

31. The article of footwear according to claim 28, wherein the first range of rotation is from about 20 degrees to about 25 degrees.

32. The article of footwear according to claim 28, wherein the second range of rotation is after about 25 degrees.

33. The article of footwear according to claim 28, wherein said torsion element is configured such that the resistance is provided in a direction that corresponds to an inversion of the foot of a user wearing the article of footwear.

* * * * *